US011499386B2

(12) United States Patent
Lende et al.

(10) Patent No.: US 11,499,386 B2
(45) Date of Patent: Nov. 15, 2022

(54) FLEXIBLE BARREL DUMP BAILER

(71) Applicant: HALLIBURTON ENERGY SERVICES, INC., Houston, TX (US)

(72) Inventors: Gunnar Lende, Rogaland (NO); Torleik Hervik Kleppa, Rogaland (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/890,758

(22) Filed: Jun. 2, 2020

(65) Prior Publication Data

US 2021/0372216 A1 Dec. 2, 2021

(51) Int. Cl.

| | |
|---|---|
| ***E21B 27/02*** | (2006.01) |
| ***E21B 33/14*** | (2006.01) |
| ***E21B 33/134*** | (2006.01) |
| ***E21B 34/10*** | (2006.01) |
| ***E21B 33/138*** | (2006.01) |

(52) U.S. Cl.

CPC ..... *E21B 27/02* (2013.01); *E21B 33/134* (2013.01); *E21B 33/138* (2013.01); *E21B 33/14* (2013.01); *E21B 34/10* (2013.01)

(58) Field of Classification Search

CPC ..... E21B 27/02; E21B 33/13

See application file for complete search history.

(56) References Cited

U.S. PATENT DOCUMENTS 2,838,117 A * 6/1958 Clark, Jr. ..... E21B 43/26 166/283
3,213,940 A 10/1965 Wood
3,379,251 A * 4/1968 Bohn ..... E21B 27/02 166/286

(Continued)

FOREIGN PATENT DOCUMENTS

EP 2192262 A1 6/2010
WO WO 2014-084807 A1 6/2014

OTHER PUBLICATIONS

International Search Report and Written Opinion issued by the Korean Patent Office ISA regarding related International Application No. PCT/US2020/036203, dated Feb. 24, 2021, 10 pages.

(Continued)

*Primary Examiner* — Catherine Loikith
(74) *Attorney, Agent, or Firm* — McAfee & Taft

(57) ABSTRACT

A system and method for injecting bailer content utilizing a dump bailer having an elongated, flexible bailer receptacle secured between a head assembly and an injection assembly. Disposed within the dump bailer are first and second piston assemblies, each of which includes a piston having a central fluid passage with a pressure actuated flow control mechanism in the form of a rupture disk disposed along the fluid passage of the piston. An electric, positive displacement pump within the head assembly draws wellbore fluid into the dump bailer assembly to drive the first piston assembly towards the second piston assembly so as to release bailer content into a wellbore. The elongated flexible bailer recep- (Continued)

tacle may be a hose stored on a bailer receptacle reel, which hose may be paid out by the reel to a length that corresponds with a volume of bailer content to be released into the wellbore.

8 Claims, 13 Drawing Sheets

(56) References Cited

U.S. PATENT DOCUMENTS

| | | | | |
|---|---|---|---|---|
| 4,696,343 | A | 9/1987 | Anderson et al. | |
| 4,739,829 | A | 4/1988 | Brunner | |
| 5,392,856 | A * | 2/1995 | Broussard, Jr. | E21B 23/06 166/169 |
| 6,561,269 | B1 * | 5/2003 | Brown | C04B 28/34 166/101 |
| 8,668,005 | B2 | 3/2014 | Colon et al. | |
| 8,813,841 | B2 | 8/2014 | Carisella | |
| 9,038,714 | B2 | 5/2015 | Colon et al. | |
| 9,790,755 | B2 | 10/2017 | Bourque | |
| 9,822,597 | B2 | 11/2017 | Carisella | |
| 9,976,370 | B2 | 5/2018 | Boleyn, Jr. | |
| 2003/0150614 | A1 | 8/2003 | Brown et al. | |
| 2010/0155054 | A1 | 6/2010 | Innes et al. | |
| 2012/0160483 | A1 | 6/2012 | Carisella | |
| 2012/0247755 | A1 | 10/2012 | Colon et al. | |
| 2014/0174720 | A1 | 6/2014 | Colon et al. | |
| 2014/0318782 | A1 | 10/2014 | Bourque | |
| 2014/0326465 | A1 | 11/2014 | Carisella | |
| 2017/0175471 | A1 | 6/2017 | Boleyn, Jr. | |
| 2017/0306714 | A1 | 10/2017 | Haugland | |

OTHER PUBLICATIONS

International Search Report and Written Opinion issued by the Korean Patent Office ISA regarding related International Application No. PCT/US2020/036207, dated Feb. 24, 2021, 10 pages.

International Search Report and Written Opinion issued by the Korean Patent Office, ISA regarding related International Application No. PCT/US2020/036212, dated Feb. 24, 2021, 10 pages.

* cited by examiner

FLEXIBLE BARREL DUMP BAILER

TECHNICAL FIELD OF THE INVENTION

This invention relates, in general, to equipment utilized in conjunction with operations performed in a subterranean well and, in particular, to a positive displacement dump bailer and a method of operating the positive displacement dump bailer.

BACKGROUND OF THE INVENTION

A dump bailer is a wellbore tool use to deposit bailer content in the form of a fluid or material, typically cement slurry, in a wellbore. Dump bailers are typically lowered into the wellbore on a conveyance vehicle such as wireline, a slickline, coiled tubing or the like. For example, a dump bailer can be used to deposit cement slurry onto a mechanical plug or packer in the wellbore. More specifically, a dump bailer can be utilized to isolate pressure between two regions in a well by deploying a cement plug. In certain installations, this is accomplished by first installing a mechanical plug, packer or bridge plug in a well at the desired location of the cement plug base and then lowering a dump bailer carrying a cement slurry into the casing on a conveyance vehicle. Once the dump bailer is positioned in the desired location proximate the mechanical plug, the dump bailer is actuated to release the cement slurry. The cement slurry is deposited on a platform formed by the mechanical plug and is supported by this plug during curing. Other means of temporary cement plug support can also be applied.

In one type of dump bailer, gravity is used to dispense the cement slurry from the dump bailer. The bailer may be spring loaded. In another type of dump bailer, explosive components are used to generate pressure to urge the cement slurry from the dump bailer. In a further type of dump bailer, a drive motor rotates a screw to dispense the cement slurry from the dump bailer.

Current dump bailers either have a limitation on maximum practical length or they rely on free fall of the bailer content into the wellbore below. This may limit the volume of content that can be released in one run. Moreover, this can render the effectiveness of the bailer sensitive to gel strength and viscosity, such that a dump bailer may not properly drain all of its content, particularly if the wellbore is oriented at a high inclination. Further, in such dump bailers, there is no control of the drain rate recognizing that too rapid of a drain rate causes turbulence and intermixing with brine or water in the wellbore, which can impact the properties of the bailer content due to dilution and loss of viscosity. In this regard, currently, long cement plugs require multiple dumps, extending the time of the overall cementing operation and creating new dilution potential for each dump such that the final cement plug is not homogenous since the cement of each dump may have different curing times.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
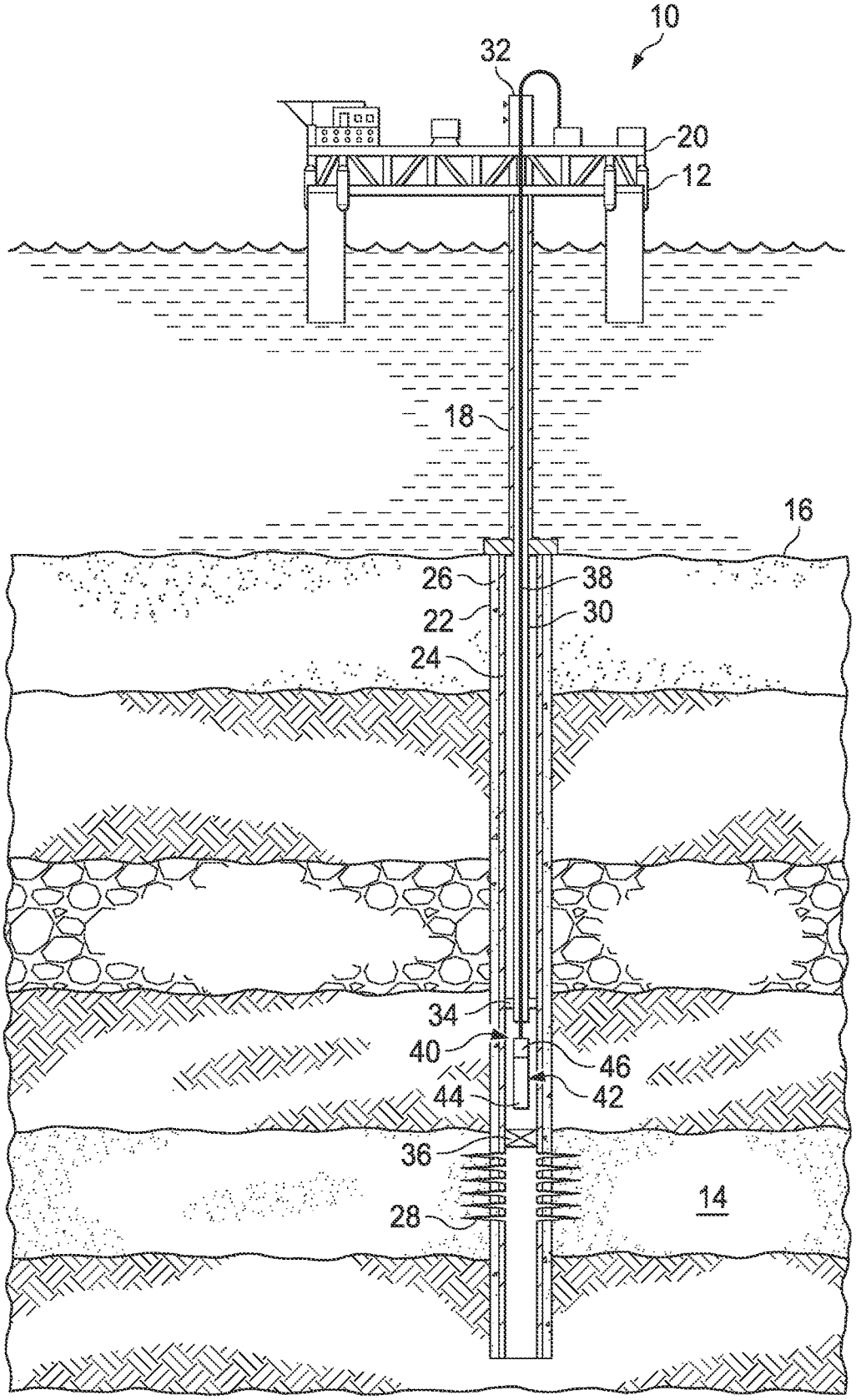
FIG. 1 is a schematic of an offshore oil and gas floating rig during the deployment of a dump bailer assembly having an integrated pump.

Disclosed herein is a dump bailer for releasing fluids into a wellbore. The dump bailer includes a tool body having a first end, a second end and an exterior surface. Formed within the tool body is an elongated bailer receptacle having a cavity formed therein and extending from a first cavity end to a second cavity end. A piston assembly having a first piston with a first surface and an opposing second surface and an outer perimeter may be slidably disposable within the cavity and movable between the first cavity end and the second cavity end. Bailer content, such as a liquid or slurry, is disposed in the cavity between the first piston and the second cavity end. In one or more embodiments, an electric pump is carried by the tool body and is disposed along a fluid passage extending from the exterior surface of the tool body to the first cavity end, thereby permitting wellbore fluid to be pumped to the into the cavity to pressurize the first side of the piston and drive the piston from the first cavity end to the second cavity end so as to release the bailer content from the cavity. In one or more embodiments, the first piston includes a piston fluid passage extending between the first and second piston surfaces with a rupture disk disposed along the piston fluid passage. In one or more embodiments, the piston assembly also includes a second piston disposed in the cavity between the first piston and the second cavity end. The second piston may include a piston fluid passage and a rupture disk similar to the first piston. In these embodiments, the second piston rupture disk may have a lower rupture pressure than the first piston rupture disk. In one or more embodiments, the dump bailer may include a vibrator carried by the tool body. The vibrator may be positioned adjacent the first end or the second end of the cavity to improve release of the bailer content, and improve placement of the bailer content into the potentially complex geometry of the wellbore. The vibrator may be electric or hydraulic. In one or more embodiments, the tool body may include a head assembly at the first end of the tool body and an injection assembly at the second end of the tool body. The elongated bailer receptacle may be bendable. The cavity formed within the bendable receptacle fluidically connects the head assembly and the injection assembly. The head assembly and the injection assembly may each be formed of a rigid mandrel and the bendable elongated bailer receptacle may be formed of a flexible hose, bendable tubing or the like. In these embodiments, a hose reel and hose feeder may be provided as a deployment system for transportation and/or feeding the bendable receptacle of the bailer into the wellbore. In one or more embodiments, an engagement mechanism may be provided at the second end of the tool body and disposed to engage a sealing assembly disposed within the wellbore. In one or more embodiments, two flow passages may be provided at the second end of the tool body, each flow passage extending from the second end of the tool body and in fluid communication with the cavity, where one flow passage has a one-way valve permitting flow from the second end of the tool body into the cavity and one flow passage has a one-way valve permitting flow from the cavity to the second end of the tool body. Centralizers, potentially equipped with friction reducing devices such as rollers, or friction reducing devices such as rollers without centralizers may be carried along the exterior surface of the tool body to facilitate deployment in wellbores of high inclination. Likewise, a pressure collar may be provided along the exterior surface of the tool body to permit pump down of the dump bailer in the wellbore.

Referring initially to FIG. 1, a dump bailer assembly of the present invention is being deployed from an offshore oil and gas platform or rig that is schematically illustrated and generally designated 10. A semi-submersible rig 12 is positioned over oil and gas formations 14 located below sea floor 16. A subsea riser 18 extends from deck 20 of rig 12 to sea floor 16. A wellbore 22 extends from sea floor 16 and traverses formations 14. Wellbore 22 includes a casing 24 that is supported therein by cement 26. Hydraulic communication between the interior of casing 24 and formation 14 has been established by perforations 28.

A tubing string 30 extends from wellhead 32 into casing 24 to provide a conduit for production fluids to travel to the surface. A sealing assembly 34, such as a packer, provides a fluid seal between tubing string 30 and casing 24 and directs the flow of production fluids from formation 14 to the interior of tubing string 30. A through tubing bridge plug 36 has been previously installed in casing 24 below tubing string 30 as a first step in plugging wellbore 22. Extending from the surface within tubing string 30 is a conveyance mechanism 38, such as a slickline, wireline, cable, coiled tubing or the like, used to convey a dump bailer assembly 40 into wellbore 22.

The dump bailer assembly 40 is generally formed of a tool body 42 which includes a bailer receptacle 44 into which bailer content (not shown) can be charged for release into wellbore 22. Without limiting the disclosure, such bailer content may include fluids, such as cement slurries or treatment chemicals, or solids, such as sand. For purposes of illustration, the bailer content will be described as a cement slurry. In any event, in one or more embodiments, an electric pump 46 is also carried by the tool body 42. As will be described in more detail below, the electric pump 46 is utilized to pump fluid from wellbore 22 into receptacle 44 in order to displace the bailer content carried in receptacle 44. Where the bailer content is cement slurry, the energized electric pump 46 draws wellbore fluid into the dump bailer assembly 40 and introduces the wellbore fluid into the receptacle 44 under sufficient pressure to drive the cement slurry out of dump bailer assembly 40 and into casing 24. Even though dump bailer assembly 40 is described as dispensing a cement slurry into casing 24, it is to be understood by those skilled in the art that dump bailer assembly 40 could be alternatively be used to dispense other wellbore agents including, but not limited to, acids, sands or the like.

Power may be supplied to electric pump 46 either locally by a battery or similar power storage device (not shown), or by an electrical cable forming part of conveyance mechanism 38 extending from rig 12.

Although pump 46 has been described as an electric pump, in other embodiments, pump 46 may be actuated hydraulically or by other drive mechanisms. For example, where pump 46 is a hydraulic pump, a hydraulic line (not shown) may extend from rig 12. Likewise, pump 46 is not limited to a particular type, but may include positive displacement pumps as well as dynamic pumps. Pump 46 may also be reversible.

Even though FIG. 1 depicts a vertical well, it should be understood by those skilled in the art that the present invention is equally well-suited for use in wells having other configurations including deviated wells, inclined wells, horizontal wells, multilateral wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIG. 1 depicts an offshore operation, it should be understood by those skilled in the art that the present invention is equally well suited for use in onshore operations. Also, even though FIG. 1 depicts a cased wellbore, it should be understood by those skilled in the art that the present invention is equally well suited for use in open hole operations. Also, even though FIG. 1 depicts a cased wellbore and placing a sealant inside this wellbore, it should be understood by those skilled in the art that the present invention is equally well suited for placing a fluid into the annulus formed by a tubing or casing and the casing or wellbore outside said tubing or casing. Thus, dump bailer assembly 40 is not limited to use with a particular type of wellbore.

Figure 2A:
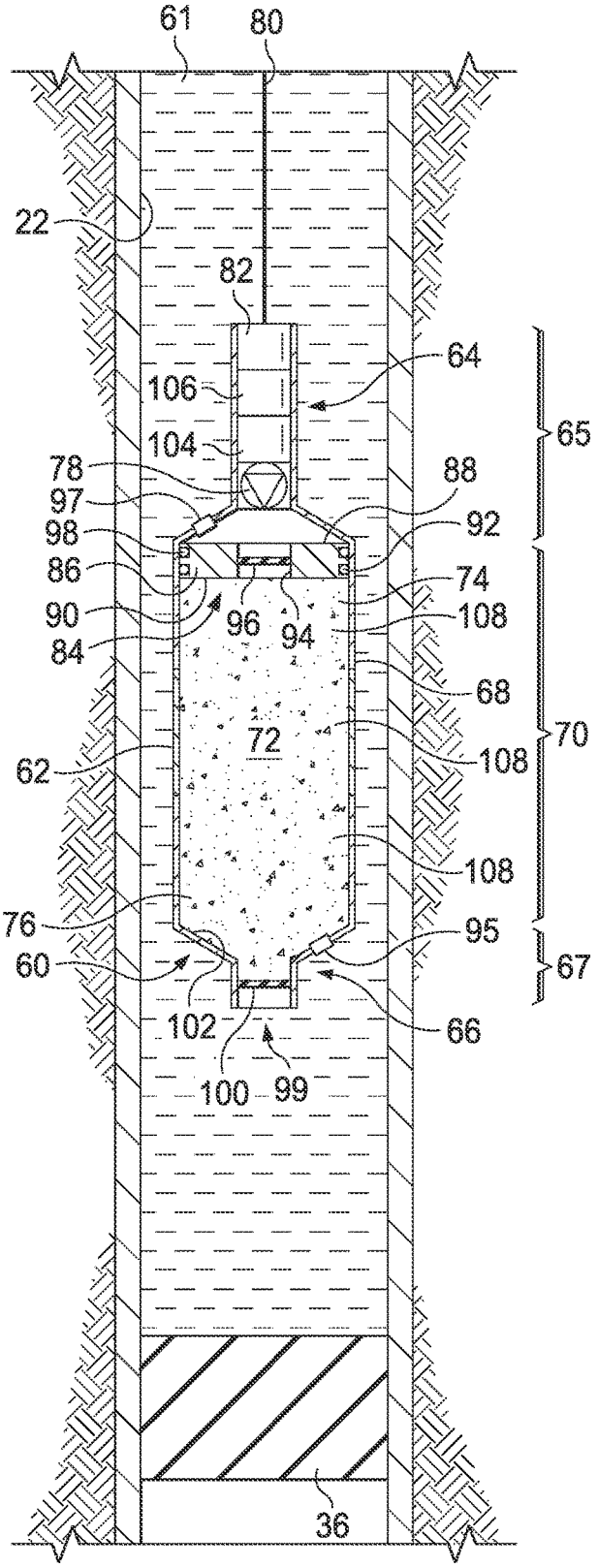
FIG. 2A is a schematic of the dump bailer assembly of FIG. 1 prior to injection of bailer content.
Figure 2B:
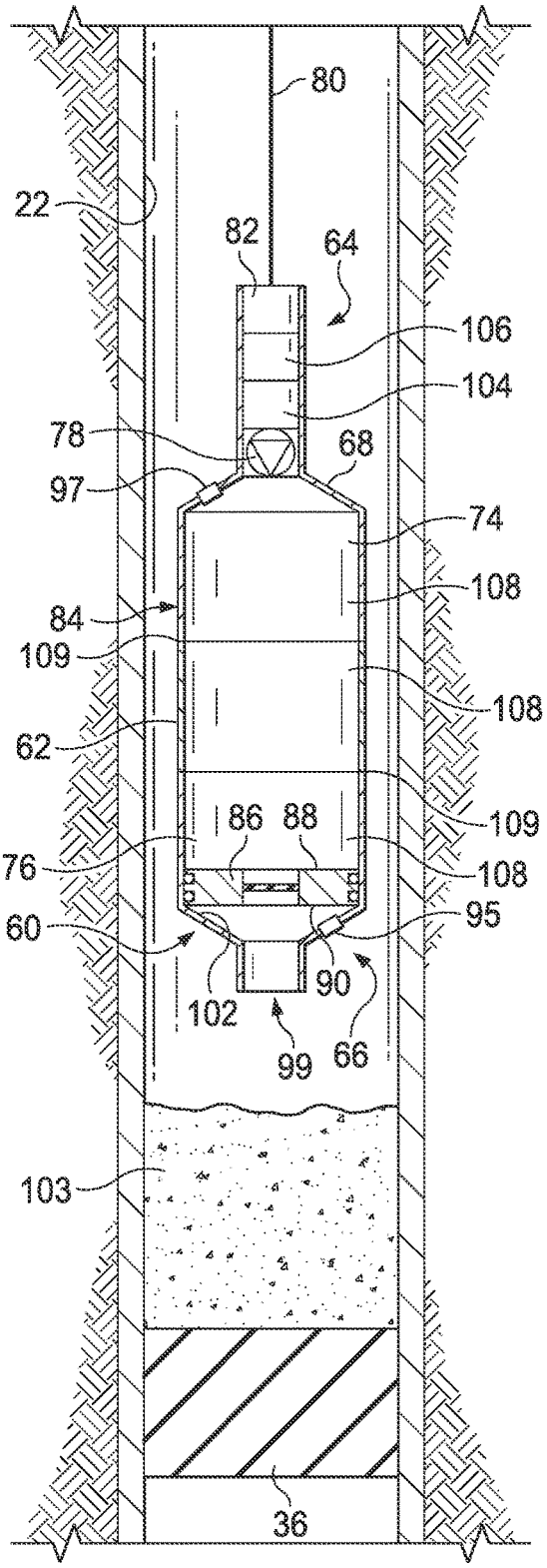
FIG. 2B is a schematic of the dump bailer assembly of FIG. 1 following injection of bailer content into the wellbore.

One embodiment of dump bailer assembly 40 of FIG. 1 is depicted in FIGS. 2A-2B as dump bailer assembly 60, which is schematically depicted as a cut-away view of dump bailer assembly 60 disposed in a wellbore 22 surrounded by wellbore fluid 61. In the illustrated embodiment, dump bailer assembly 60 includes a tool body 62 having a first (upper) end 64 and a second (lower) end 66, with a head assembly 65 disposed at the first end 64 and an injection assembly 67 disposed at the second end 66. Tool body 62 is also characterized as having an exterior surface 68. Dump bailer assembly 60 also includes an elongated bailer receptacle 70 carried by the tool body 62 and extending between the head assembly 65 and the injection assembly 67. Formed within bailer receptacle 70 is a cavity 72 extending from a first cavity end 74 to a second cavity end 76. In this embodiment, dump bailer assembly 60 also includes a pump 78 carried by the tool body 62 and in fluid communication with the first cavity end 74 of cavity 72. Pump 78 may be integrated as part of head assembly 65. Thus, in some embodiments, the pump 78 is positioned adjacent the first end 64 of the tool body 62 as part of head assembly 65. As described above, in one or more embodiments, pump 78 may be an electric pump. Similarly, in one or more embodiments, pump 78 may be a positive displacement pump. One or both of head assembly 65 and injection assembly 67 may be a rigid mandrel.

In the illustrated embodiment, the conveyance mechanism 80 for deployment of dump bailer assembly 60 is shown as a wireline attached to a conveyance adapter 82 attached to tool body 62 adjacent the first end 64. In another embodiment, conveyance mechanism may be a slickline, coiled tubing or other type of cable.

In one or more embodiments, a piston assembly 84 may be slidably disposable within the cavity 72 and movable between the first cavity end 74 and the second cavity end 76. The piston assembly 84 may include a piston 86 with a first surface 88 and an opposing second surface 90 and an outer perimeter 92. A piston flow passage 94 extends through piston 86 between the first surface 88 and the second surface 90. A flow control mechanism 96 is disposed along the piston flow passage 94. In one or more embodiments, flow control mechanism 96 is a rupture disk disposed to rupture at a first activation pressure $P_1$. In other embodiments, flow control mechanisms 96 may be a valve disposed to open above the first activation pressure $P_1$ and close below the first activation pressure $P_1$. Piston assembly 84 may be initially carried within the head assembly 65 during deployment of dump bailer assembly 60. One or more seals 98 may be disposed around the outer perimeter 92 of the piston 86. In one or more embodiments, seal 98 may be a wiper. In this regard, in one or more embodiments, piston assembly 84 may be a wiper plug. In other embodiments, piston 86 may be rubber, metal, plastic, polymer or foamed version of said elements. Moreover, although piston 86 has been described as generally disk shaped, having opposing surfaces 88, 90 and an outer perimeter 92, in other embodiments, piston 86 may have other shapes, including without limitation, a plug, a ball, or a cylinder.

In one or more embodiments, head assembly 65 may include a valve 97 such as a relief valve or equalizing check valve, to permit pressure within the head assembly 65 to be equalized with pressure at the exterior surface 68 of tool body 62 in the case that the external pressure exceeds the cavity pressure, for example when the bailer assembly is lowered into the wellbore at increasing hydrostatic pressure. Check valve 97 may be utilized to ensure external pressure cannot significantly exceed internal pressure, such as for example in cases where injection assembly 67 does not have a equalizing valve (see valve 132*b* of FIG. 3), flow control mechanisms 96 may be damaged or tool body 62 may collapse if pump 78 becomes plugged.

In one or more embodiments, injection assembly 67 may include a valve 95 such as a relief valve or equalizing check valve, often referred to as float valve, to permit wellbore fluid to enter into the cavity 72 under the piston 84 when the dump bailer assembly 60 is first lowered into the wellbore 22.

In one or more embodiments, injection assembly 67 may include an exit port 99 with a flow control mechanism 100 disposed to control flow through the exit port 99. In one embodiment, flow control mechanism 100 is a rupture disk disposed to rupture at a second activation pressure $P_2$ selected to be less than the first activation pressure $P_1$ of flow control mechanism 96 of piston assembly 84, such that flow control mechanism 100 actuates at a lower pressure than flow control mechanism 96. In other embodiments, flow control mechanisms 96 may be a valve disposed to open at a second activation pressure $P_2$ less than the first activation pressure $P_1$.

Injection assembly may also include an internal shoulder 102 on which the piston assembly 84 may land after traversing cavity 72. In one or more embodiments, the dump bailer assembly 60 may include a vibrator 104 carried by the tool body 62. Although the disclosure is not limited by the positioning in of vibrator 104, in one or more embodiments, vibrator 104 may be positioned adjacent the first end 64 or the second end 66 of tool body 62 to facilitate release of bailer content from bailer receptacle 70 and improve placement of the bailer content into the potentially complex geometry of the wellbore 22. In the illustrated embodiment, vibrator 104 is shown as part of head assembly 65. In other embodiments, vibrator 104 may be part of injection assembly 67. In such embodiments, vibrator 104 may be positioned adjacent flow control mechanism 100. Vibrator 104 is not limited to a particular type of vibrator so long as vibrator 104 can used energy waves to enhance flow of bailer content through or from dump bailer assembly 60. Thus, in one or more embodiments, vibrator 104 may be electric or hydraulic or sonic.

In one or more embodiments, the dump bailer assembly 60 may include a locator mechanism 106, such as a casing collar locator ("CCL"), carried by tool body 62. Although not limited to a particular position along tool body 62, in the illustrated embodiment, locator mechanism 106 is positioned adjacent the first end 64 of tool body 62 and forms part of head assembly 65. In any event, locator mechanism 106 is not limited to a particular device. In some embodiments, locator mechanism 106 may be an electric logging tool that detects the magnetic anomaly caused by the relatively high mass of the casing collar or other known casing features deployed at known measured depths along wellbore 22. As described below, in one or more embodiments, dump hailer assembly 60 may have a bailer receptacle 70 that makes if difficult to provide electric or hydraulic control to the injection assembly 67, such as where bailer receptacle 70 is a hose. Thus, in some embodiments, only head assembly 65 may include electric or hydraulically actuated components, such as an electric locator mechanism 106, an electrically actuated vibrator 104 or electric pump 78. In such case electric power (or hydraulic fluid, as the case may be), is provided to head assembly 65 by conveyance mechanism 80, which may include an electric cable and/or hydraulic line.

In one or more embodiments, bailer receptacle 70 may be formed of one or more lengths 108 of rigid cylindrical tube or pipe, which lengths may be interconnected at joints 109 (see FIG. 2B). In other embodiments, bailer receptacle 70 may be a single, elongated length of rigid tube or pipe. In yet other embodiments, bailer receptacle 70 may be a flexible or bendable tubing or hose. In any case, cavity 72 is likewise an elongated and axially extending. It will be appreciated that because of the inclusion of electric pump 78 in one or more embodiments, the length of bailer receptacle 70, regardless of the material or characteristics of its construction, is not limited as it is in the types of forced fluid displacement dump bailers of the prior art, which have a maximum length dictated by the effective stroke or gas expansion limitations.

In FIG. 2A, dump bailer assembly 60 is shown having been lowered into wellbore 22 on conveyance mechanism 80, which in the illustrated embodiment is a wireline, to a target location proximate a preinstalled bridge plug 36. At this point, piston 86 is positioned adjacent the first cavity end 74 of bailer receptacle 70. In this regard, during deployment of dump bailer assembly 60, piston 86 may be carried within head assembly 65 or alternatively, within bailer receptacle 70. In either case, cavity 72 is charged with bailer content in the form a cement slurry between the piston 86 and the second cavity end 76 of cavity 72. To commence operation, pump 78 is actuated to pump wellbore fluid 61 from wellbore 22 into dump bailer assembly 60 and apply an internal bailer fluid pressure $P_{IB}$ to the first surface 88 of piston 86. As the fluid pressure $P_{IB}$ at first surface 88 continues to increase, the fluid pressure $P_{IB}$ of the pumped wellbore fluid 61 will push piston 86 towards second cavity end 76, such as is shown in FIG. 2B. Movement of piston 86 towards second cavity end 76 will in turn generate a bailer content pressure $P_{BC}$ on the bailer content within cavity 72 so as to drive bailer content within cavity 72 out of dump bailer assembly 60 via exit port 99. In particular, in one or more embodiments, as piston 86 is driven from first cavity end 74 to second cavity end 76, the bailer content pressure $P_{BC}$ within cavity 72 will increase to a point that it is greater than the second activation pressure $P_2$ of flow control mechanism 100. If flow control mechanism 100 is a valve, bailer content pressure $P_{BC}$ above second activation pressure $P_2$ will drive valve to an open position, allowing bailer content to be released from bailer receptacle 70. If flow control mechanism 100 is a rupture disk or similar rupture device, then the bailer content pressure $P_{BC}$ above second activation pressure $P_2$ will cause rupture of the control mechanism, again allowing bailer content to be released from bailer receptacle 70. In each case, it will be appreciated that this second activation pressure $P_2$ is selected to be less than the first activation pressure $P_1$ that results in activation of flow control mechanism 96. In other embodiments, flow control mechanism 100 may be an electric or hydraulic valve that can be selectively actuated as desired.

In any event, with flow control mechanism 100 actuated, the downward movement of the piston 86 urges the cement slurry out of dump bailer assembly 60 and dispenses the cement slurry into wellbore 22 and onto bridge plug 36 to form a cement plug 103. Cement plug 103 is allowed to cure on bridge plug 36. Following operation, dump bailer assembly 60 can be retrieved to the surface.

In some embodiments, the electrical signal to pump 78 can be adjusted to alter the flowrate of pump 78, which in turn can be used to control the flow rate of bailer content discharged from dump bailer assembly 60 through valve 100. This allows greater control over the injection flowrate of bailer content over prior art dump bailer assemblies.

Figure 3:
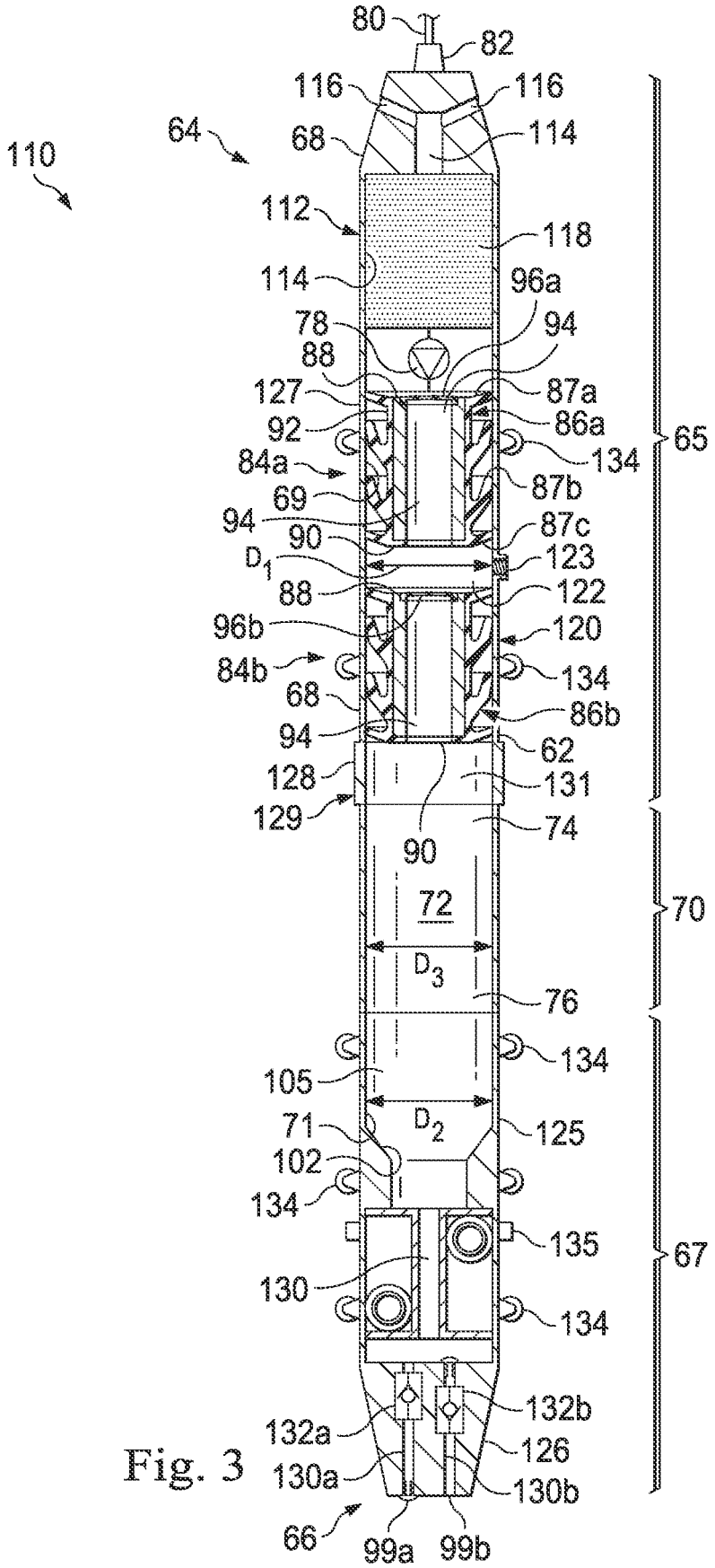
FIG. 3 is a cut-away schematic of a dump bailer assembly with a pump and two piston assemblies.

Another embodiment of dump bailer assembly 40 of FIG. 1 is depicted in FIG. 3 as dump bailer assembly 110. Dump bailer assembly 110, like dump bailer assembly 60, includes a tool body 62 having a first end 64 and a second end 66, with a head assembly 65 disposed at the first end 64 and an injection assembly 67 disposed at the second end 66. Tool body 62 is also characterized as having an exterior surface 68. Head assembly 65 includes an internal bore 69 with an inner diameter $D_1$. Likewise, injection assembly 67 includes an internal bore 71 with an inner diameter $D_2$. Dump bailer assembly 60 also includes an elongated bailer receptacle 70 carried by the tool body 62 and extending between the head assembly 65 and the injection assembly 67. Formed within bailer receptacle 70 is a cavity 72 extending om a first cavity end 74 to a second cavity end 76 and having an inner diameter $D_3$. In this embodiment, dump bailer assembly 60 also includes a pump 78 carried by the tool body 62 and in fluid communication with the first cavity end 74 of cavity 72 via internal bore 69. Thus, in some embodiments, the pump 78 is positioned adjacent the first end 64 of the tool body 62 as part of head assembly 65.

Also positioned adjacent the first end 64 of the tool body 62, between the wireline adapter 82 and the pump 78 is a fluid head 112 in which is defined a fluid passage 114 extending from one or more ports 116 in the exterior surface 68 of the tool body 62 to a fill chamber 122 defined within a tubular portion 120 of head assembly 65. Pump 78 is positioned along fluid passage 114 and is disposed to draw wellbore fluid (see FIG. 2A) through ports 116 into fluid passage 114 and pump the wellbore fluid to piston assembly 84*a*, and in particular, to first surface 88 of piston 86*a*. In one or more embodiments, a fluid filter assembly 118 may be positioned along fluid passage 114 to filter wellbore fluid flowing into dump bailer assembly 110. Filter assembly 118 is not limited to a particular type of filter. In one or more embodiments, filter assembly 118 may be a metal slotted or mesh screen.

In the illustrated embodiment, piston assembly 84*a* is shown carried in a tubular portion 120 of the head assembly 65. In particular, fluid passage 114 is in fluid communication with internal bore 69 of head assembly 65 which extends within tubular portion 120. Piston assembly 84*a* is positioned within internal bore 69. In this regard, the inner diameter $D_1$ of internal bore 69 is selected to allow piston 86*a* of piston assembly 84*a* to translate along internal bore 69. In other embodiments, piston assembly 84*a* may be positioned in or adjacent the first cavity end 74 in bailer receptacle 70. In any event, piston assembly 84*a* is slidably disposed to translate from fill chamber 122, through cavity 72 between the first cavity end 74 and the second cavity end 76 to injection assembly 67. Thus, as with the inner diameter $D_1$ of internal bore 69, the inner diameter $D_3$ of cavity 72 is selected to allow piston 86*a* of piston assembly 84*a* to translate along cavity 72.

As described above, piston assembly 84*a* may include a piston 86*a* with a first surface 88 and an opposing second surface 90 and an outer perimeter 92. In the illustrated embodiment of FIG. 3, piston assembly 84*a* is tubular in shape, although in other embodiments, piston assembly 84 may be disk shaped or have other shapes. A piston flow passage 94 is shown extending through piston 86*a* between the first surface 88 and the second surface 90. A flow control mechanism 96*a* is disposed along the piston flow passage 94 of piston 86*a*. In the illustrated embodiment, flow control mechanism 96*a* is a rupture disk disposed to rupture at first activation pressure $P_1$. In the illustrated embodiment, piston assembly 84*a* includes an upper wiper seal 87*a*, one or more intermediate wiper seals 87*b*, and a lower wiper seal 87*c* projecting from the outer perimeter 92 of piston 86*a*.

In some embodiment, such as is illustrated in FIG. 3, dump bailer assembly 110 includes piston assembly 84*a* as a first piston assembly, as well as a second piston assembly 84*b* spaced apart from first piston assembly 84*a*. Second piston assembly 84*b* likewise may include a piston 86*b* with a first surface 88 and an opposing second surface 90 and an outer perimeter 92. In the illustrated embodiment of FIG. 3, piston assembly 84*b* is tubular in shape. A piston flow passage 94 is shown extending through piston 86*b* between the first surface 88 and the second surface 90. A flow control mechanism 96*b* is disposed along the piston flow passage 94 of piston 86*b*. In the illustrated embodiment, flow control mechanism 96 is a rupture disk disposed to rupture at second activation pressure $P_2$, where, much like the embodiments illustrated in FIGS. 2A and 2B, second activation pressure $P_2$ is selected to be less than first pressure $P_1$. In the illustrated embodiment, piston assembly 84*b* includes an upper wiper seal 87*a*, one or more intermediate wiper seals 87*b*, and a lower wiper seal 87*c* projecting from the outer perimeter 92 of piston 86.

As shown, first and second piston assemblies 84*a*, 84*b* are spaced apart from one another within tubular portion 120 of the head assembly 65 to define fill chamber 122 for initial receipt of bailer content (not shown). To facilitate filling, a fill port 123 that can selectively be opened and closed may be provided in tubular portion 120. In one or more embodiments, tubular portion 120 is a rigid mandrel forming part of head assembly 65. Tubular portion 120 is further characterized as having a first end 127 closest to adapter 82 and a second end 128 adjacent bailer receptacle 70, and, in some embodiments, may include an attachment mechanism 129 adjacent the second end 128 for securing bailer receptacle 70 to head assembly 65. In one or more embodiments, attachment mechanism 129 may be a collar. Second end 128 may also include a gripping area 131 for engagement by a dog collar or similar device (not shown) for temporarily securing dump bailer assembly 60 during preparation for deployment into wellbore 22, particularly where bailer receptacle 70 is a hose as described below. As such, it will be appreciated that gripping areas 131, and thus, the second end 128 of tubular portion 120, may be reinforced or have a greater wall thickness.

In one or more embodiments, injection assembly 67 shown in FIG. 3 also includes a tubular portion 125, and the above-described internal bore 71 of injection assembly 67 extends within tubular portion 125. Internal bore 71 of injection assembly 67 is disposed to receive a piston 86 of a piston assembly 84, and therefore, the inner diameter $D_2$ of internal bore 71 is selected accordingly. Shoulder 102 of injection assembly 67 may be defined along internal bore 71.

Injection assembly 67 shown in FIG. 3 may be characterized as having an exterior surface 126 adjacent second end 66 of tool body 62. In one or more embodiments, exterior surface 126 may be shaped to form a stinger for engagement with other wellbore components (not shown). A pressure collar 135 may be provided along the exterior surface of the tool body to permit pump down of the dump bailer in the wellbore.

Internal bore 71 of injection assembly 67 is in fluid communication with a fluid passage 130 extending through injection assembly 67 to exit port 99 at second end 66 of tool body 62. A flow control valve 132 may be positioned along fluid passage 130 to control flow of bailer material out of cavity 72. Flow control valve 132 may be pressure actuated. Thus, unlike gravity type dump bailers of the prior art, the flow of bailer material out of dump bailer assembly 60 can be controlled. In many instances, it is desirable to meter the bailer material out at a flow rate that does not create turbulence with wellbore fluid in wellbore 22, which could negatively impact the injection operation. For example, turbulence that might be experience with an uncontrolled release of cement slurry into wellbore 22, such as is often the case with gravity type dump bailer assemblies of the prior art, can cause wellbore fluid to mix with the cement slurry and weaken a cement plug once cured or cause segregation due to insufficient viscosity or gel strength. In one or more embodiments, fluid passage 130 may include a first fluid passage 130*a* communicating with a first exit port 99*a* and a second fluid passage 130*b* communicating with a second exit port 99*b*. In these embodiments, first fluid passage 130*a* may include a one-way flow control valve 132*a* permitting flow from the cavity 72 to the second end 66 of the tool body 62, and second fluid passage 130*b* may include a one-way flow control valve 132*b* permitting flow from the second end 66 of the tool body 62 to cavity 72. In either case, as stated above, one-way flow control valve 132*a*, 132*b* may be pressure actuated such that the valve does not open until the fluid constrained by the valve reaches a threshold actuation pressure. In some embodiments where pump 78 is reversible, pump 78 may be utilized to purge wellbore fluid from cavity 72 between piston assembly 84 and the first cavity end 74, thereby creating a lower fluid pressure $P_{IB}$ on the first surface 88 of piston 86*a*, Wellbore fluid entering second fluid passage 130*b* though one-way flow control valve 132*b* can then drive piston assembly 84*a* from adjacent the second cavity end 76 back towards the first cavity end 74 of cavity 72. In one or more other embodiments, valve 132*b* may be utilized to release wellbore fluid into the lower end 76 of cavity 72 to purge wellbore fluid from the upper end 74 of cavity 72.

In one or more embodiments, injection assembly 67 shown in FIG. 3 also includes one or more external guides 134 disposed along the exterior surface 68 of tool body 62. In one or more embodiments, external guides 134 are rollers (as shown in FIG. 3), but may be other friction reducing devices. It will be appreciated that as dump bailer assembly 60 is deployed in a wellbore, such as wellbore 22 shown in FIG. 2A, as the measured depth of a wellbore increases, particularly wellbores with significant inclines, the likelihood increases that a dump bailer assembly 60 may become stuck in the wellbore for lack of driving force. The guides 134, such as in the form of rollers or other friction reducing devices, function to keep tool body 62 centralized in the wellbore, and also reduce the effective friction coefficient allowing dump bailer assembly 60 to be pushed farther along the wellbore than would otherwise be possible. In this regard, in some embodiments, conveyance mechanism 80 may be a pipe string, coiled tubing or some other rigid or semi-rigid conveyance mechanism that with the assistance of external guides 134 can urge dump bailer assembly 60 farther along wellbore 22 than would otherwise be possible. In one or more embodiments, a plurality of guides 134 may be positioned along at least either the head assembly 65 or injection assembly 67 of dump bailer assembly 60. Similarly, in some embodiments, one or more guides 134 are positioned along each of the rigid portions of tool body 62, such as the head assembly 65 and injection assembly 67, but not along any flexible portions of the dump bailer assembly 60, such as may be the case in certain embodiments of the bailer receptacle 70. As used herein, external guide 134 refers to any mechanism that can be utilized to create standoff between dump bailer assembly 60 and the wellbore walls, including without limitation, bow springs, straight vanes, helical vanes, low friction material or rollers. In the illustrated embodiment, external guides 134 are rollers disposed on each of the head assembly 65 and injection assembly 67, but spaced apart from the bailer receptacle 70. As used herein, roller is defined to include wheels, balls, bearings or similar round or cylindrical rollable mechanisms disposed to reduce friction between the dump bailer assembly 60 and the walls or casing within wellbore 22.

Figure 4A:
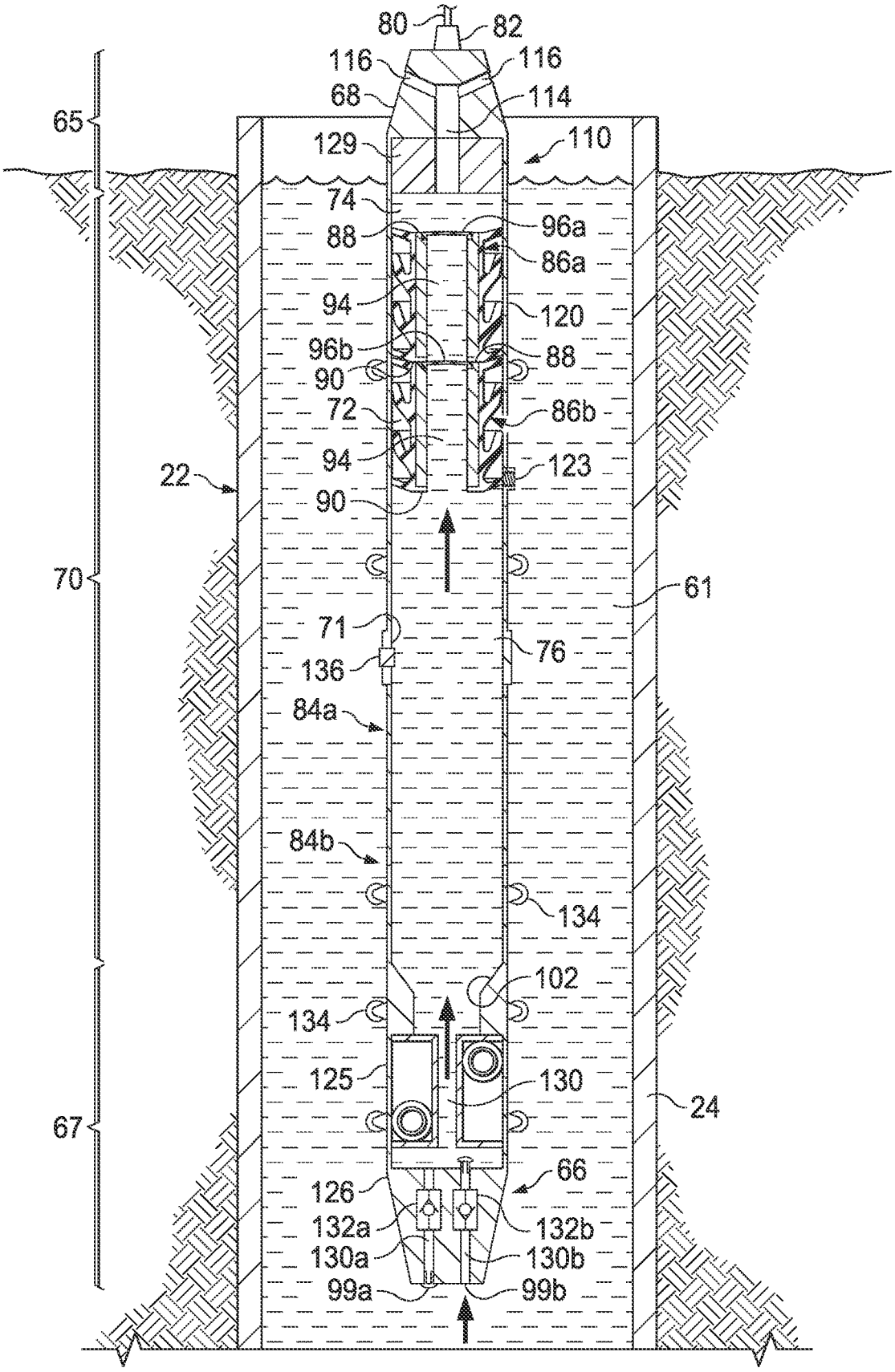
FIGS. 4A-4F are a cut-away schematics of the dump hailer assembly of FIG. 3 at different stages of an injection operation.

Turning to FIGS. 4A-4F, operation of the dump bailer assembly 110 of FIG. 3 will be described in more detail. In FIG. 4A, washout of dump bailer assembly 110 illustrated, where dump bailer assembly 110 is shown in wellbore 22 following delivery of a bailer content to a location within wellbore 22. In the illustration, dump bailer assembly 110 is surrounded by wellbore fluid 61. To equalize internal and external pressures on dump bailer assembly 110, and also prevent it from floating, in some embodiments, wellbore fluid 61 may be allowed to fill dump bailer assembly 110 110 as it is being lowered into the wellbore 22. Thus, one-way flow control valve 132*b* along fluid passage 130*b* is actuated to allow wellbore fluid 61 to pass through port 99*b* and into dump bailer assembly 110. In embodiments of dump bailer assembly 110 that include a pump 78 (shown in FIG. 4B), the pump may be reversed to draw wellbore fluid 61 into port 99*b*. In any event, wellbore fluid 61 passes through injection assembly 67 and into bailer receptacle 70 in order to fill cavity 72 with wellbore fluid 61. The wellbore fluid 61 then passes through bailer receptacle 70 and exits through a designated bleed port 136.

Figure 4B:
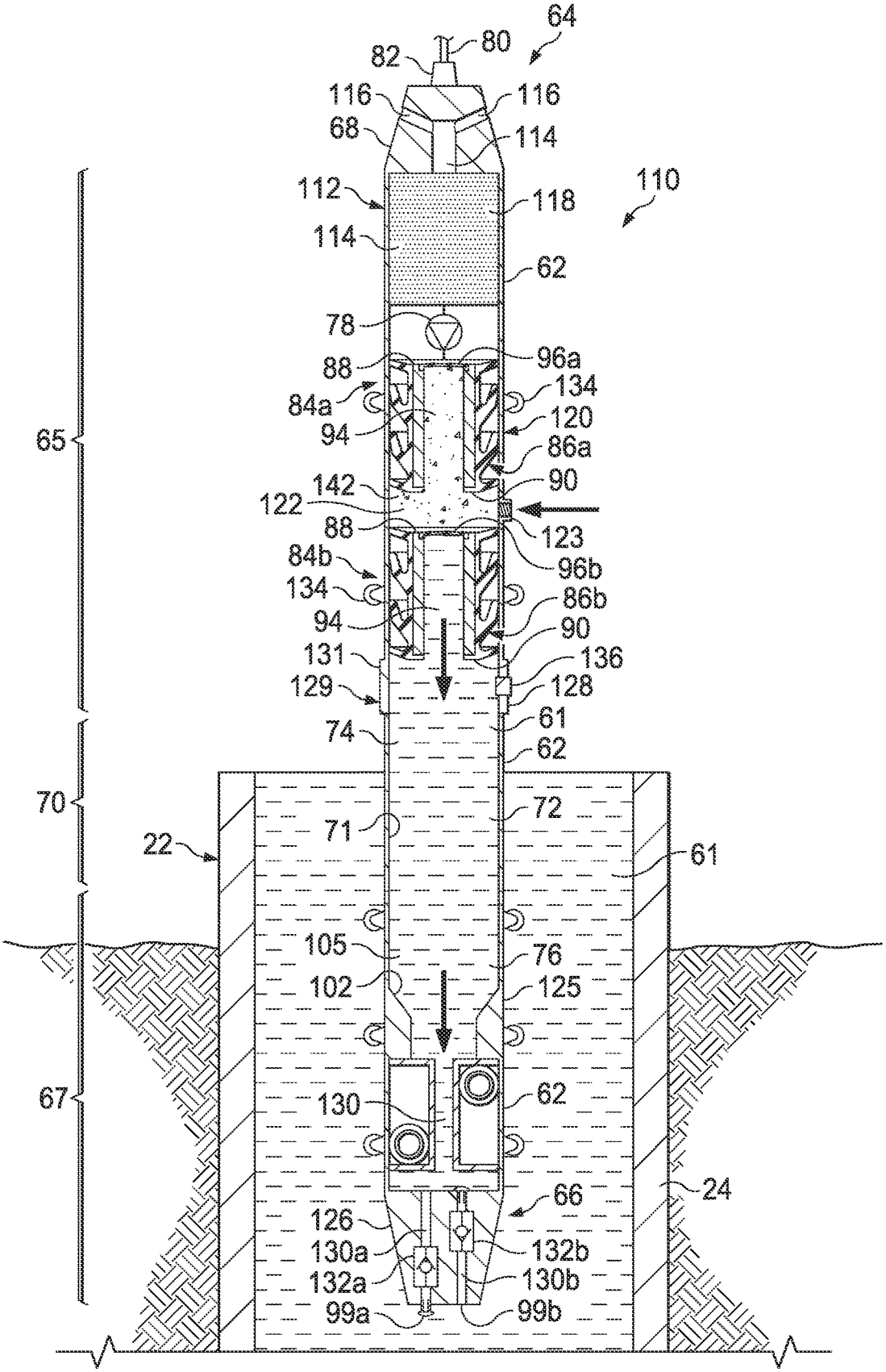

In FIG. 4B, dump bailer assembly 110 is charged with bailer content 142. In the illustrated embodiment, first and second piston assemblies 84*a*, 84*b* have been positioned in a tubular portion 120 of head assembly 65. In any event, bailer content 142 is injected into fill chamber 122 via port 123. It will be appreciated that first and second piston assemblies 84*a*, 84*b* are spaced apart from one another within fill chamber 122 with first piston assembly 84*a* closer to first end 64 of tool body 62 and second piston assembly 84*b* closer to second end 66 of tool body 62. Thus, as bailer content 142 is pumped into fill chamber 122, second piston assembly 84*b*, under pressure $P_{BC}$ from bailer content 142, is urged and begins to move toward the second end 66 of tool body 62 in particular, second piston assembly 84*b* is urged into bailer receptacle 70, thereby forcing wellbore fluid 61 within cavity 72 down through injection assembly 67, along first fluid passage 130*a*, through one-way flow control valve 132*a* and out port 99*a* adjacent the second end 66 of tool body 62. It will be appreciated that in the illustrated embodiment, at the beginning of the fill operations, both pistons 86*a*, 86*b* of piston assemblies 84*a*, 84*b* have flow control mechanisms 96*a*, 96*b* intact or otherwise set to prevent flow along their respective piston flow passages 94. In this regard, the flow control mechanism 96*b* of second piston 86*b* is set to operate or otherwise burst at a second activation pressure $P_2$ that is higher than the initial injection pressure $P_{BC}$ of the bailer content 142 into fill chamber 122.

Figure 4C:
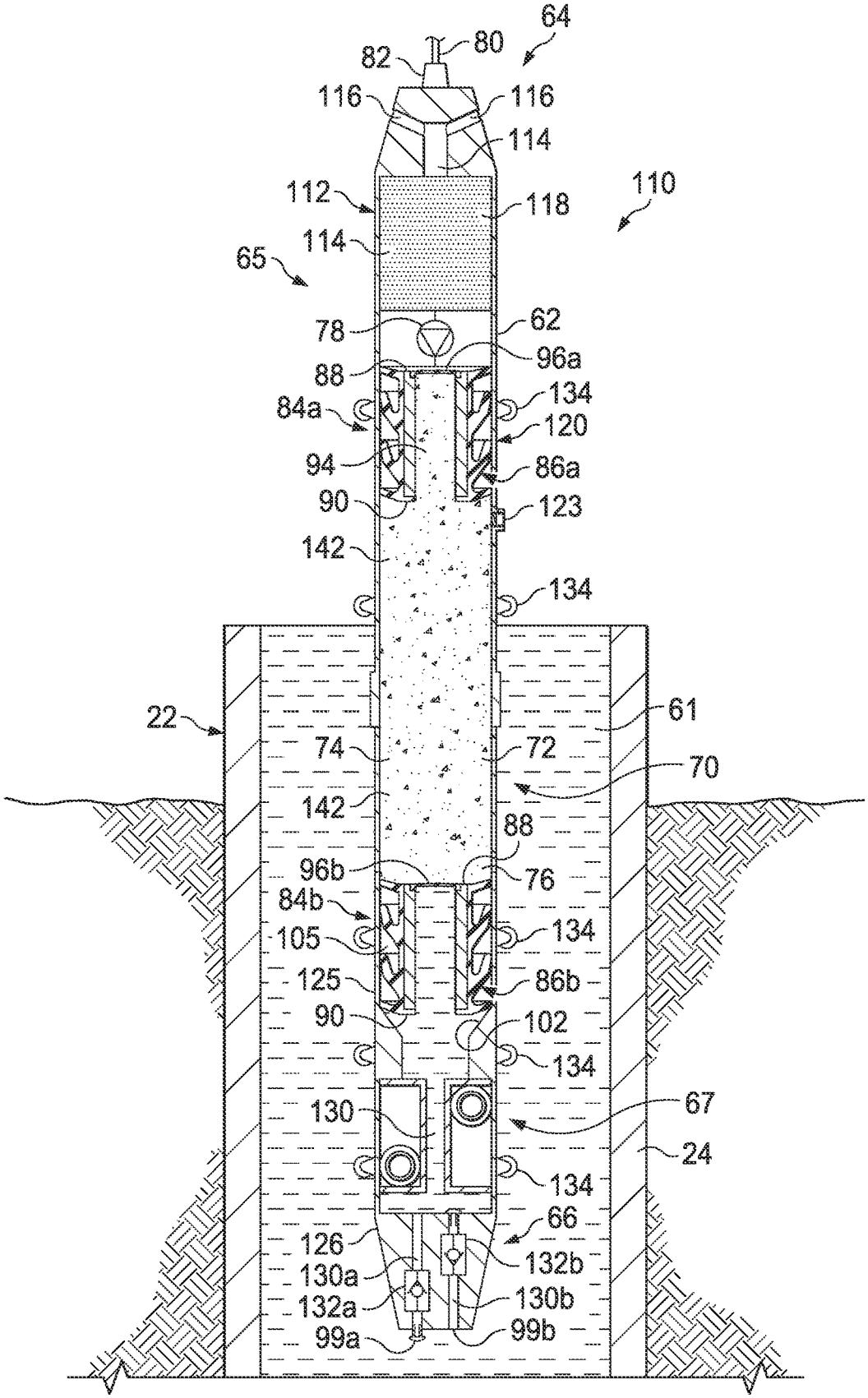

FIG. 4C illustrates dump bailer assembly 110 fully charged with bailer content 142 and ready for deployment back into wellbore 22. In the embodiment, second piston assembly 84*b* has passed through cavity 72 and landed on shoulder 102 within tubular portion 105 of injection assembly 67. The volume between the first surface 88 of second piston 84*b* and the second surface 90 (see FIG. 3) of first piston 84*a* is filled with bailer content 142. This volume may include all or a portion of cavity 72, as well as portions of head assembly 65 and injection assembly 67. In any event, dump bailer assembly 110 may now be deployed in wellbore 22 to a desired location.

Figure 4D:
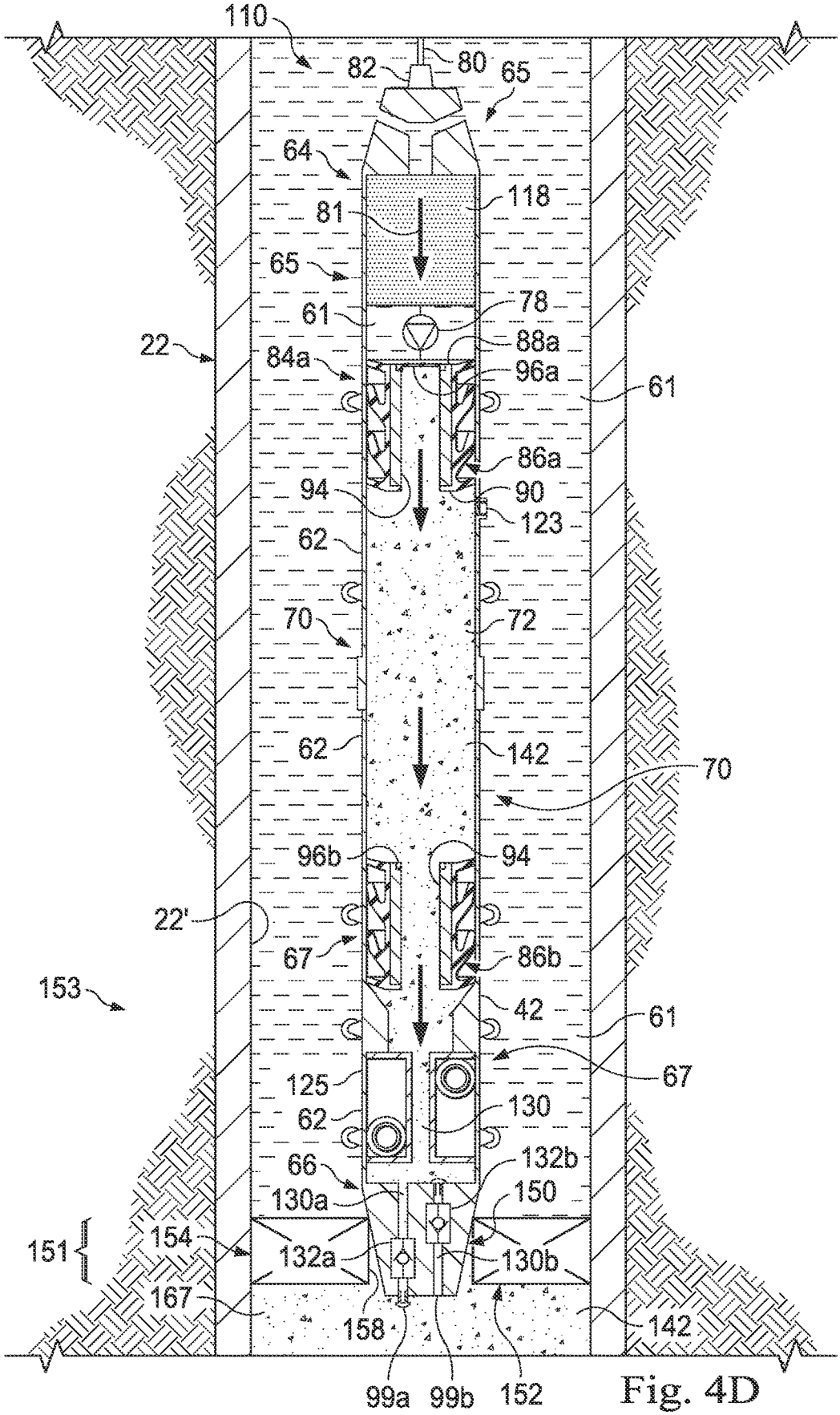

In FIG. 4D, as indicated by flow arrow 81, pump 78 is illustrated as being actuated to draw wellbore fluid 61 into dump bailer assembly 110 from wellbore 22 to increase pressure on first surface 88 of first piston assembly 84*a*. It will be appreciated that as wellbore fluid pressure $P_{IB}$ within dump bailer assembly 110 increases on first surface 88 of first piston 86*a*, first piston assembly 84*a* is urged and begins to move toward the second end 66 of tool body 62 where second piston assembly 84*b* is seated. In particular, as first piston assembly 84*a* is urged into bailer receptacle 70, the fluid pressure $P_{BC}$ of bailer content 142 within cavity 72 increases. It will be appreciated that at the beginning of operation of pump 78, both pistons 86*a*, 86*b* have flow control mechanisms 96*a*, 96*b* that are intact or otherwise set to prevent flow along their respective piston flow passages 94. However, as illustrated, as first piston assembly 84*a* moves towards the second end 66 of tool body 62, fluid pressure $P_{BC}$ of bailer content 142 within cavity 72 increases until the fluid pressure $P_{BC}$ of bailer content 142 reaches second activation pressure $P_2$ of flow control mechanism 96*b* of second piston 86*b*. Where flow control mechanism 96*b* of second piston 86*b* is a burst disk, as fluid pressure $P_{BC}$ of bailer content 142 reaches second activation pressure $P_2$, flow control mechanism 96*b* ruptures, allowing bailer content 142 within cavity 72 to pass through flow passage 94 of second piston 86*b*, along first fluid passage 130*a*, through one-way flow control valve 132*a* and out port 99*a* adjacent the second end 66 of tool body 62. Notably, it will be appreciated that the differential fluid pressure $P_{IB}$ applied across first surface 88 of first piston 86*a* during this portion of the bailer content injection process remains below the first activation pressure P of flow control mechanism 96*a* of first piston assembly 84*a*.

In embodiments of dump bailer assembly 110 having a filter assembly 118, such as is shown in FIG. 4D, wellbore fluid drawn in by pump 78 may be filtered of wellbore fines before being pumped into chamber 122.

While dump bailer assembly 110 as described above may be deployed in a wellbore 22 and utilized to deliver bailer content 142 at any desired location within the well, in some embodiments, dump bailer assembly 110 may be disposed for engagement with a sealing assembly 154 disposed at a select location within wellbore 22, or any other suitable geometry present, thereby forming a dump bailer system 153 for injection of bailer content 142, such as cement slurry, into wellbore 22. In this regard, as mentioned above, in some embodiments, injection assembly 67 may include a stinger at exterior surface 126 (see FIG. 4C). Likewise, in one or more embodiments, dump bailer assembly 110 may include an engagement mechanism 150 for engagement with a corresponding engagement mechanism 152 carried by sealing assembly 154. Although engagement mechanism 150 may be carried along any portion of tool body 42, in one or more embodiments, engagement mechanism 150 is carried by injection assembly 67 adjacent the second end 66 of tool body 62. As described herein, engagement mechanisms 150 and 152 are not limited to a particular type of engagement device, but in some embodiments, may be any latching device known to persons of ordinary skill in the art. In one or more embodiments, engagement mechanism 150 may be one or more lugs or pins disposed along the exterior surface 126 of injection assembly 67, while engagement mechanism 152 may be a pocket or channel profile formed along an interior bore 158 of sealing assembly 154. Together, engagement mechanisms 150 and 152 form a latch assembly 151. In some embodiments, such latch assembly 151 may be mechanically actuated. In some embodiments, such latch assembly 151 may be electrically actuated.

Likewise, sealing assembly 154 is not limited to a particular type of sealing assembly but may be any sealing assembly known to persons of ordinary skill in the art for sealing cased or encased wellbores. In one or more embodiments, sealing assembly 154 is elastomeric and engages the walls 22' of wellbore 22. In one or more embodiments, sealing assembly 154 is a packer. In one or more embodiments, sealing assembly 154 is a plug. In one or more embodiments, sealing assembly 154 includes a bore 158 formed therein. In any event, in one or more embodiments, a portion of injection assembly 67 seats within bore 158 of sealing assembly 154, allowing engagement mechanism 150 of dump bailer assembly 110 to engage engagement mechanism 152 of sealing assembly 154. In these embodiments, as dump bailer assembly 110 begins to release bailer content 142 into wellbore 22, the bailer content 142 is contained within a desired section 167 of wellbore 22 by sealing assembly 154. This may prevent wellbore fluid 61 outside of the desired section 167, such as the wellbore fluid 61 shown in FIG. 4D about the first end 64 of dump bailer assembly 110, from interfering with the injection operation.

Figure 4E:
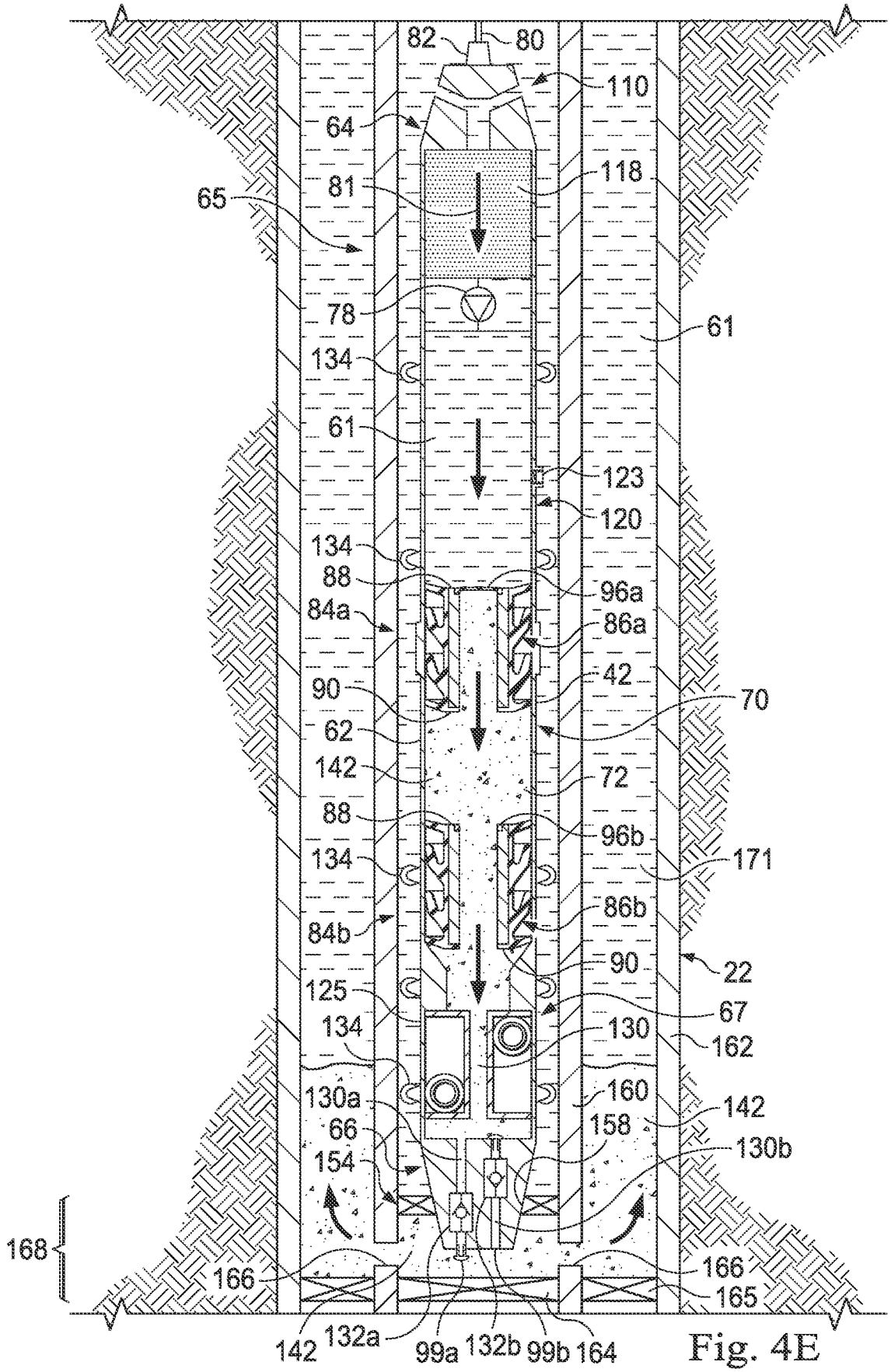

In FIG. 4E, first piston assembly 84*a* is shown passing through cavity 72. In this particular embodiment, bailer content 142 is cement slurry and dump bailer assembly 110 is shown installing the cement slurry between an inner sleeve 1110 and an outer sleeve 162 of wellbore 22. In particular, second and third sealing assemblies 164, 165, respectively, are shown spaced apart from sealing assembly 154 about openings or apertures 166 formed in the inner sleeve 1110, thus defining an injection zone 168 for receipt of the cement slurry. Because dump bailer assembly 110 is latched into sealing assembly 154, as pump 78 pumps wellbore fluid 61 into cavity 72 to drive first piston assembly 84*a* towards the second end 66 of tool body 62, the cement slurry is driven out of dump hailer assembly 110 and through openings 166 into the annulus 171 formed between the inner and outer sleeves 1110, 162, respectively.

Also shown in this embodiment, guides 134 may be utilized to align injection assembly 67 as it seats within interior bore 158 of sealing assembly 154. Thus, as described above, in addition to assisting in moving dump bailer assembly 110 through wellbore 22 to a desired location, guides 134 may also function as part of dump bailer system 153 to direct dump bailer assembly into sealing engagement with sealing assembly 154.

Figure 4F:
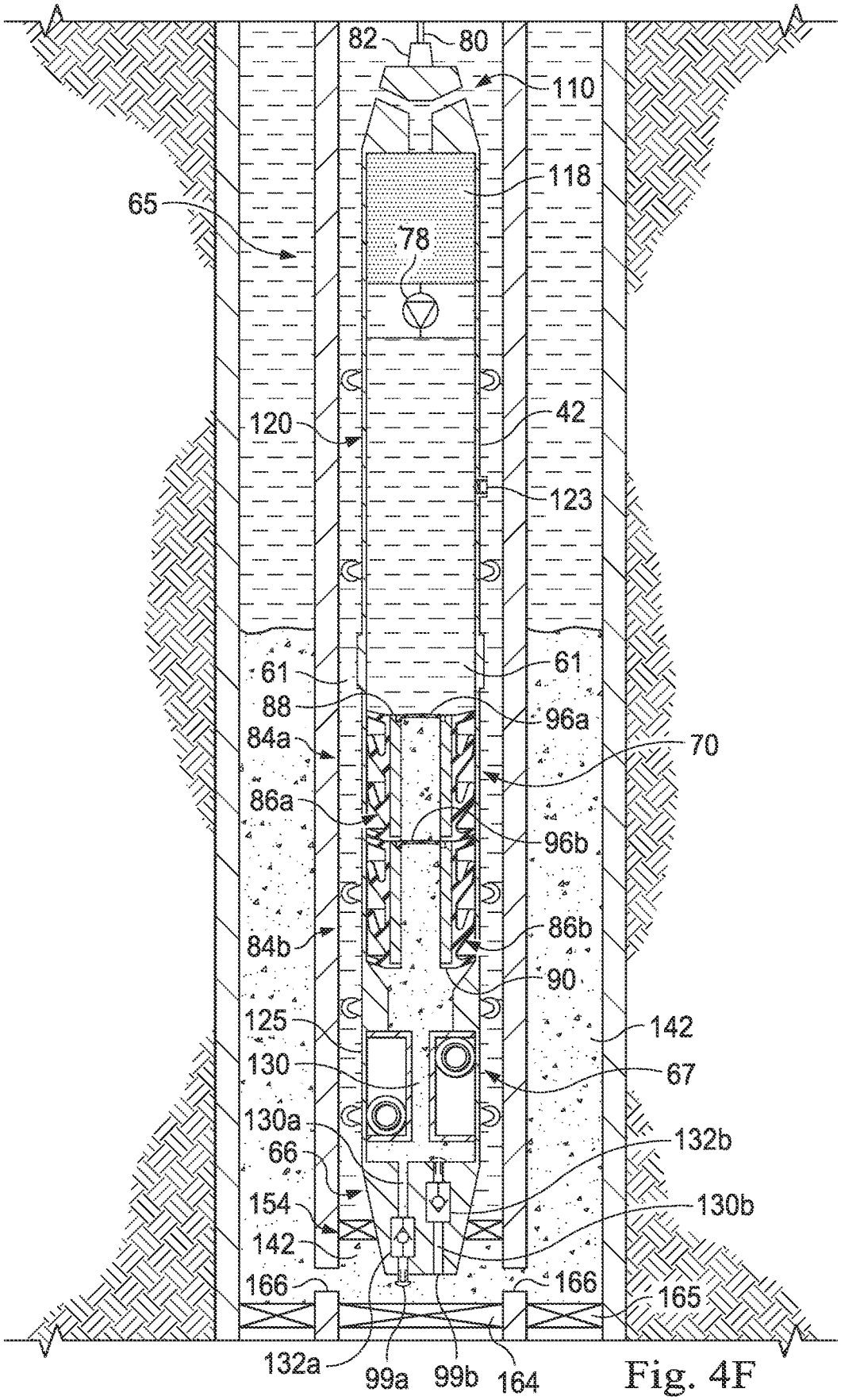

In FIG. 4F, first piston assembly 84*a* is shown having landed on second piston assembly 84*b* having urged all bailer content 142 through second piston assembly 84*b* and out of dump bailer assembly 110. In this embodiment, as described above, flow control mechanism 96*a* is a rupture disk disposed to rupture at a first activation pressure $P_1$ and the internal bailer fluid pressure $P_{IB}$ has been maintained at a level below first activation pressure $P_1$ but sufficiently high to drive first piston 86*a* through cavity 72 of bailer receptacle 70. Upon landing of first piston assembly 84*a* on second piston assembly 84*b*, internal bailer fluid pressure $P_{IB}$ may be increased to first activation pressure $P_1$ causing rupture of flow control mechanism 96*a* and allowing cavity 72 to be flushed with wellbore fluid 61, or flow control mechanism 96*a* may be left intact. In one or more embodiments, flow control mechanism 96*a* is a pressure actuated valve, that can be opened and closed based on the internal bailer fluid pressure $P_{IB}$. Thus, flow control mechanism 96*a* could be opened to allow cavity 72 to be flushed, but then closed to allow a pressure differential between the first surface 88 and the second surface 90 of first piston 86*a* to urge the first piston assembly 84*a* back towards first end 64 of tool body 62. The same is also true of second piston assembly 84*b*, where flow control mechanism 96*b* may be a pressure actuated valve.

Figure 5A:
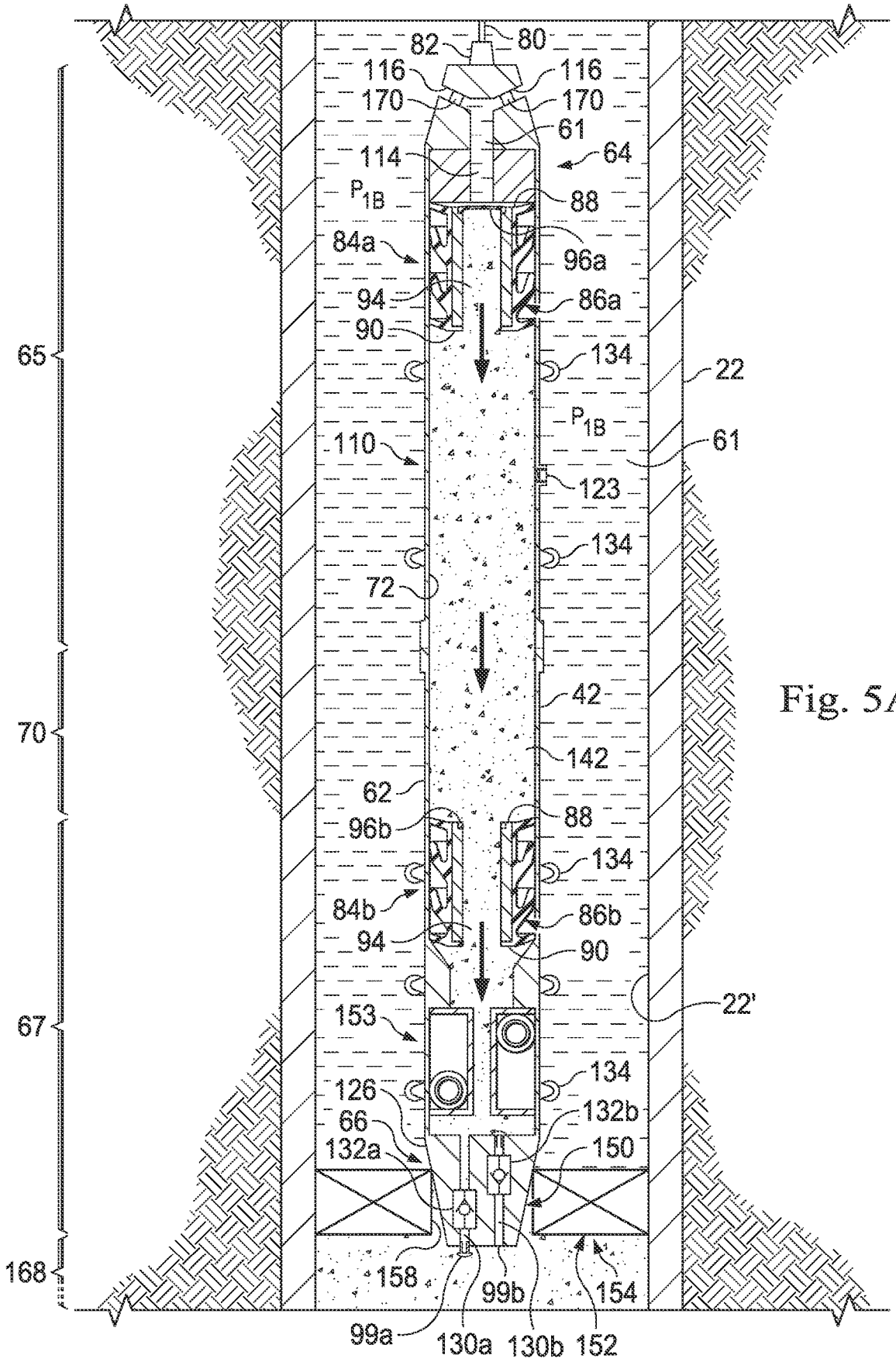
FIG. 5A is a dump bailer assembly latched to a sealing assembly disposed within a wellbore.

In FIG. 5A, dump bailer assembly 110 is shown seated on sealing assembly 154 as described above with engagement mechanisms 150 and 152 engaged with one another. However, in this embodiment of dump bailer system 153, dump bailer assembly does not include a pump. Rather, wellbore pressure $P_w$ of wellbore fluid 61 is utilized to drive first piston assembly 84*a* towards second end 66 of tool body 62. In this embodiment, head assembly 65 is shown having fluid passages 114 formed therein leading from ports 116 to first surface 88 of first piston assembly 84*a*. In one or more embodiments, each port 116 may include a valve 170 that may be actuated to open and close its respective port 116 as desired to control flow of wellbore fluid 61 into dump bailer assembly 110. In one or more embodiments, valve 170 may be electric. In one or more embodiments, valve 170 may be actuated by pressure. In this regard, valve 170 may be a burst disk or similar rupture mechanism that ruptures when wellbore pressure $P_w$ reaches a certain threshold. In such embodiments, dump bailer assembly 110 may be installed as described above and then the pressure $P_w$ of wellbore fluid 61 may be raised above a threshold activation pressure, activating valve 170 so as to open ports 116 and permitting wellbore fluid 61 to flow into dump bailer assembly 110. It will be appreciated that because dump bailer assembly 110 is seated on sealing assembly 154, and engagement mechanisms 150 and 152 are engaged, sealing contact is established between sealing assembly 154 and dump bailer assembly 110. Thus, the wellbore fluid pressure $P_w$ of wellbore fluid 61 can be raised as desired without impacting injection zone 168. It will be appreciated that a sealing mechanism (not shown) typically provided adjacent the wellhead 32 (see FIG. 7A) to seal about conveyance mechanism 80 as dump bailer assembly 110 is lowered into wellbore 22 and engaged with sealing assembly 154. As such, once dump bailer assembly 110 is engaged with sealing assembly 154, wellbore 22 is a sealed volume from the wellhead 32 to dump bailer assembly 110. As such, the release of bailer content 142 from dump bailer assembly 110 can be controlled from the surface 183 (see FIG. 7A) by pumping fluid 61 into wellbore 22 to increase wellbore pressure $P_w$. In this regard, the rate bailer content 142 released from dump bailer assembly 110 below sealing assembly 154 can be controlled by controlling the rate of wellbore fluid 61 pumped into wellbore 22 above seal assembly 154, thereby achieving the same results as the pump 78 described in FIG. 4.

In other embodiments, engagement mechanism 150 is disposed along a different part of tool body 62. Thus, engagement mechanism 150 may be disposed adjacent head assembly 65. As such, during deployment, dump bailer assembly 110 is passed through interior bore 158 of sealing assembly 154 until engagement mechanism 150 engages engagement mechanism 152, to form a seal therebetween. Again, guides 134 may be used to facilitate alignment of dump bailer assembly 110 with interior bore 158 to assist in engaging engagement mechanism 150 and engagement mechanism 152. This arrangement is particularly desirable where receptacle 4470 may be flexible or bendable as described below. In such instance, increasing pressure $P_w$ of wellbore fluid 61 in order to activate dump bailer assembly 110 will not affect receptacle 70.

Figure 5B:
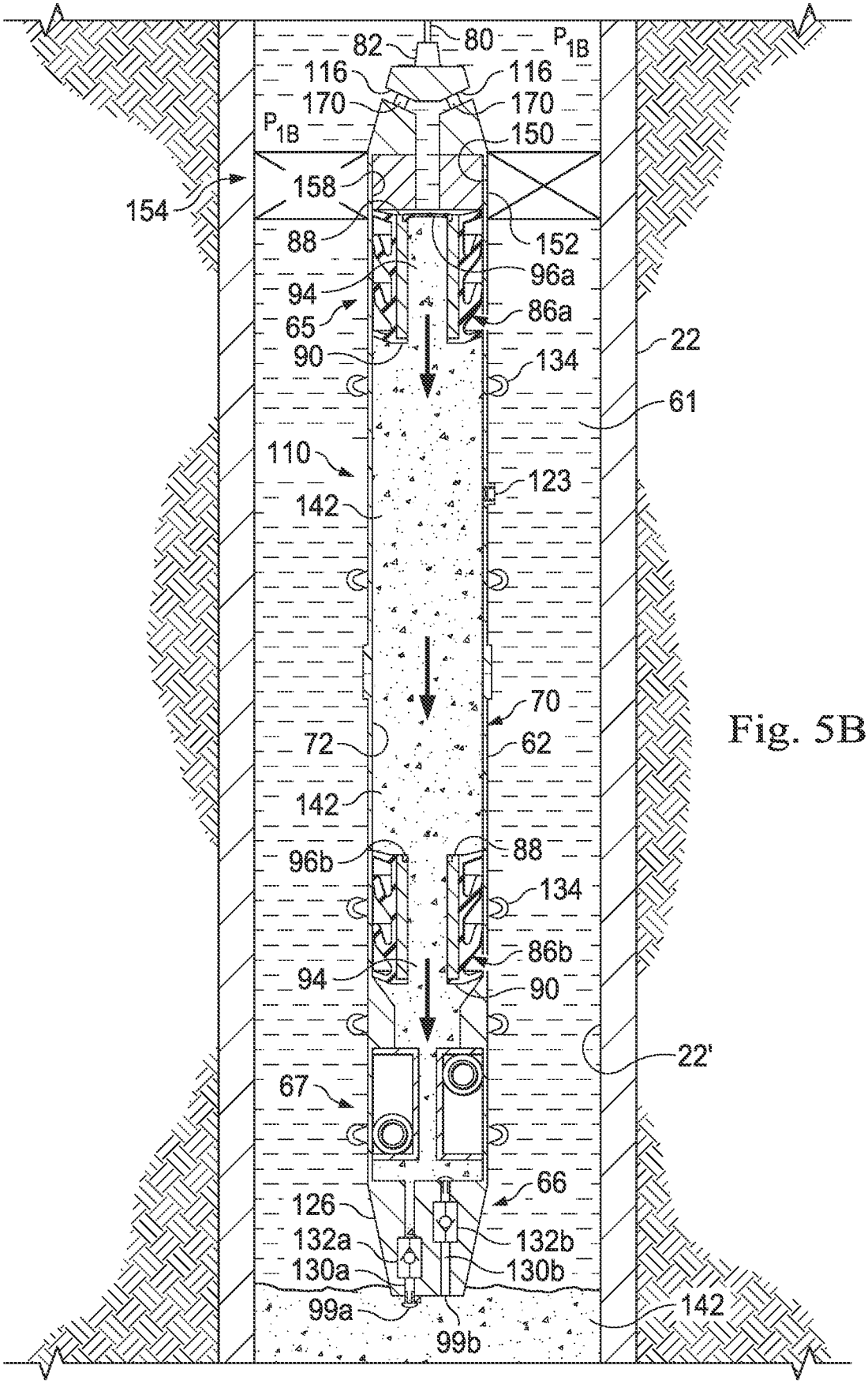
FIG. 5B is a dump bailer assembly carrying an integrated sealing assembly.

The arrangement of dump bailer system 153 in FIG. 5B is similar to the second embodiment described above with respect to FIG. 5A, except that rather than utilizing engagement mechanisms 150, 152 to secure dump bailer assembly 110 to a sealing assembly 154 downhole, sealing assembly 154 is integrated into dump bailer assembly 110. Specifically, sealing assembly 154 is shown in FIG. 5B forming a part of head assembly 65 to permit sealing assembly 154 to seal wellbore 22 once dump bailer assembly 110 has been positioned at a desired location within wellbore 22. During installation, once dump bailer assembly 110 is at a desired location, the sealing assembly 154 may be activated to seal against wellbore wall 22. Sealing assembly 154 is not limited to a particular type of sealing assembly, but can be any sealing assembly known in the industry to persons of skill in the art. Without limiting the foregoing, sealing assembly 154 may be an inflatable packer. In some embodiments, sealing assembly 154 may include electromeric elements. In one or more embodiments, sealing assembly 154 may be hydraulically, pneumatically or electrically actuated. It will be appreciated that while sealing assembly 154 may be located anywhere along tool body 62, in one or more embodiments, sealing assembly 154 is located adjacent first end 64 of tool body 62, thus forming a part of head assembly 65 because head assembly 65 is most readily provided with the electric, hydraulic or pneumatic control necessary to actuate sealing assembly 154. As described above, such control may be included via the conveyance mechanism 80 supporting the dump bailer assembly 110.

In one or more embodiments, bailer receptacle 70 of tool body 62 is elongated and bendable or flexible. In such case, the head assembly 65 and the injection assembly 67 may each be formed of a rigid mandrel and the elongated bailer receptacle 70 may be formed bendable or semi-rigid material such as flexible hose, bendable tubing, coiled tubing or the like. As such, elongated bailer receptacle 70 may be continuous or semi-continuous with long bendable or semi-rigid jointed sections. For example, such long, semi-continuous, bendable or semi-rigid sections may be 50 meters or more in length. Likewise, elongated bailer receptacle 70 may be jointless. In any case, the cavity 72 formed in such elongated, semi-rigid or bendable bailer receptacle 44 is similarly elongated and bendable. In one or more embodiments, elongated bailer receptacle 70 is a flexible hose formed of one or more outer layers of woven fabric with an inner layer of rubber, allowing the hose to be readily rolled for storage. Such construction is commonly used, for example, in fire hoses wherein the inner rubber layer is sufficiently thin to substantially flatten under the weight of the hose, and the outer woven fabric layers are sufficient to restrain high pressure fluid within the hose. In one or more embodiments, elongated bailer receptacle 70 is non-metal. In one or more embodiments, elongated bailer receptacle 70 is formed of reinforced plastic.

Figure 6:
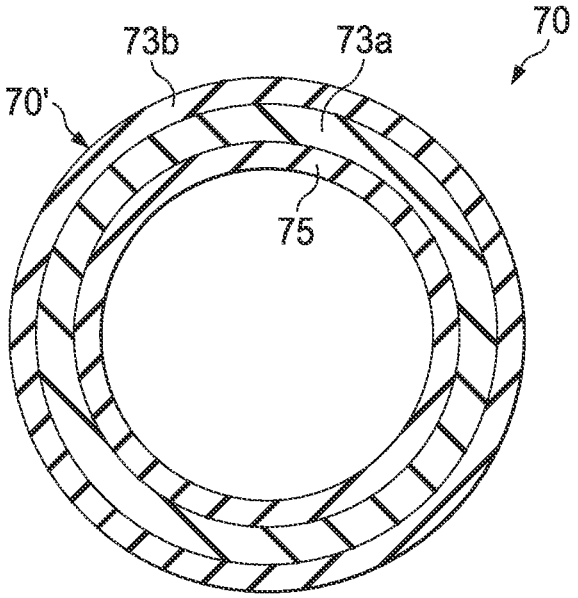
FIG. 6 is a cross-section of an embodiment of a flexible bailer receptacle of a dump bailer assembly.

An example of such a hose is illustrated in FIG. 6, where a cross section of bailer receptacle 70 as a hose 70' is shown. Hose 70' may be constructed of at least one or more flexible outer layers 73*a*, 73*b*, such as rubber, woven fiber, reinforced material, woven material, woven fabric, reinforced material, reinforced rubber, cloth, metal mesh or the like, and an inner flexible layer 75, such as rubber, wherein the outer flexible layer(s) 73*a*, 73*b* provide reinforcement, protection and strength, and the inner flexible layer provides fluid containment. Such hose may be foldable for easy storage. Such hose may be flat-rolled for easy storage. It will be appreciated, as described above in FIG. 3, that by utilizing a pump 78 in a dump bailer assembly 110 that includes such an elongated, semi-rigid or bendable bailer receptacle 70, the length of the elongated bailer receptacle 70 may be selected to be whatever is necessary to deliver the desired amount of bailer content 142. Moreover, to the extent the elongated bailer receptacle 70 is one long length of hose, tubing or the like, the need for joints may be minimized or eliminated, and thus the need to make up such joints may be minimized or eliminated, as the case may be. Turning back to FIG. 3, as stated above, to support an elongated, bendable or semi-rigid bailer receptacle 70, head assembly 65 of tool body 62 may be a rigid mandrel or pipe. Likewise, injection assembly 67 of tool body 62 may be a rigid mandrel or pipe. As such, jointless, the elongated cavity 72 formed within bendable elongated bailer receptacle 70 has a first cavity end 74 in fluid communication with the fluid passage 114 of the head assembly 65 and a second cavity end 76 in fluid communication with the fluid passage 130 of the injection assembly 67.

Figure 7A:
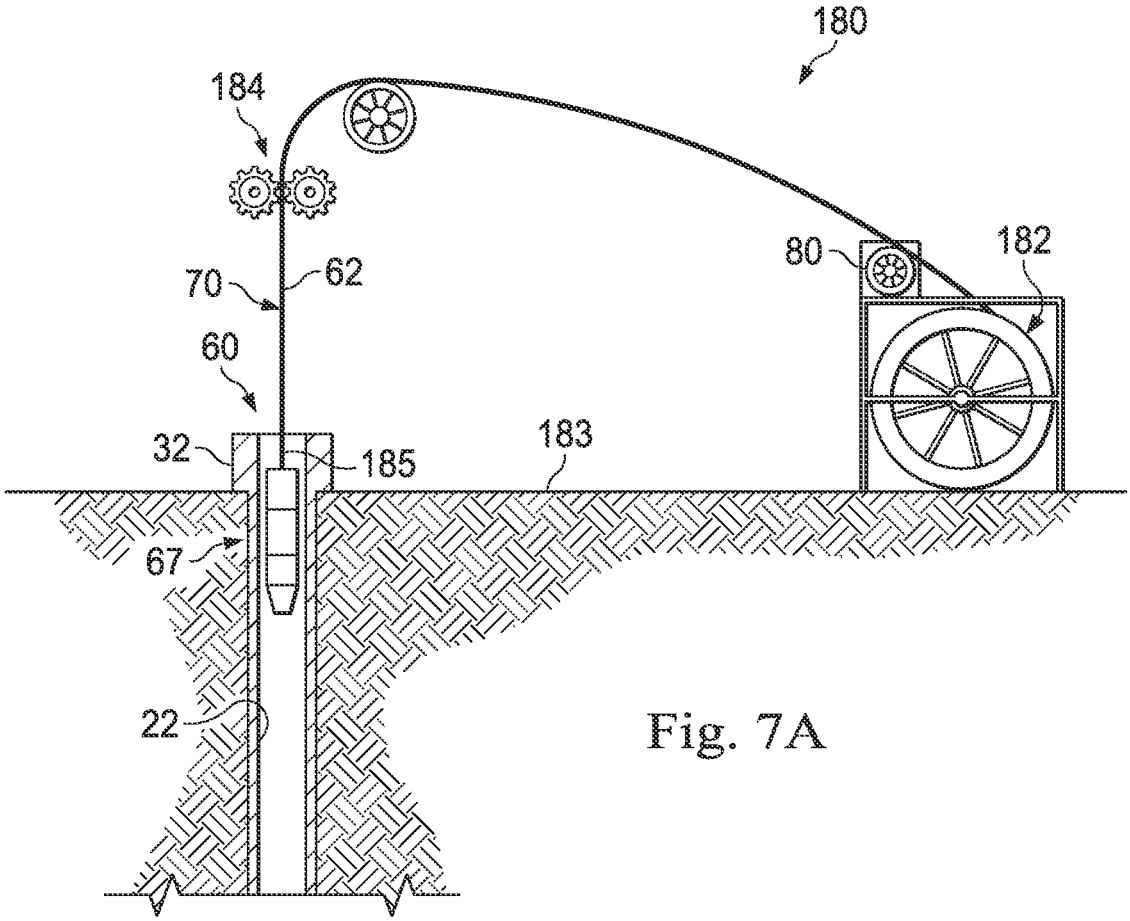
FIGS. 7A-7B are schematic depictions of a dump hailer system for installing a dump bailer assembly having a flexible bailer receptacle.

Turning to FIG. 7A, a dump bailer system 180 for deploying the above-described dump bailer assembly 60 having an elongated, bendable or semi-rigid bailer receptacle 70 is illustrated. In this illustration, dump bailer assembly 60 is only partially assembled, and thus, only a portion of dump bailer assembly 60 is shown, namely injection assembly 67 and elongated bailer receptacle 70. It will be appreciated that because elongated bailer receptacle 70 is bendable or semi-rigid, in one or more embodiments, this portion of tool body 62 may spooled or retained on a bailer receptacle reel 182 disposed adjacent surface 183 of wellbore 22 and paid out from the bailer receptacle reel 182 of dump bailer system 180. In other embodiments, rather than a bailer receptacle reel 182, bailer receptacle 70 is foldable and may be retained in a container, skid or other storage device (not shown) adjacent wellhead 32. Likewise, dump bailer system 180 may include an injector or bailer receptacle feeder 184 disposed adjacent a wellhead 32 of wellbore 22 for pulling elongated, bendable or semi-rigid bailer receptacle 70 from bailer receptacle reel 182. Feeder 184 is not limited to a particular type of feeder, but may include any feeder known in the industry. In one embodiment, feeder 184 may be opposing, counter-rotating rollers, wheels or tracks that grip bailer receptacle 70 therebetween. In the illustrated embodiment, feeder 184 is positioned above wellhead 32. In any event, as shown in FIG. 7A, the bailer receptacle 70 has a downhole or first free end 185 that is attached to injection assembly 67 before injection assembly 67 is lowered into wellbore 22.

Figure 7B:
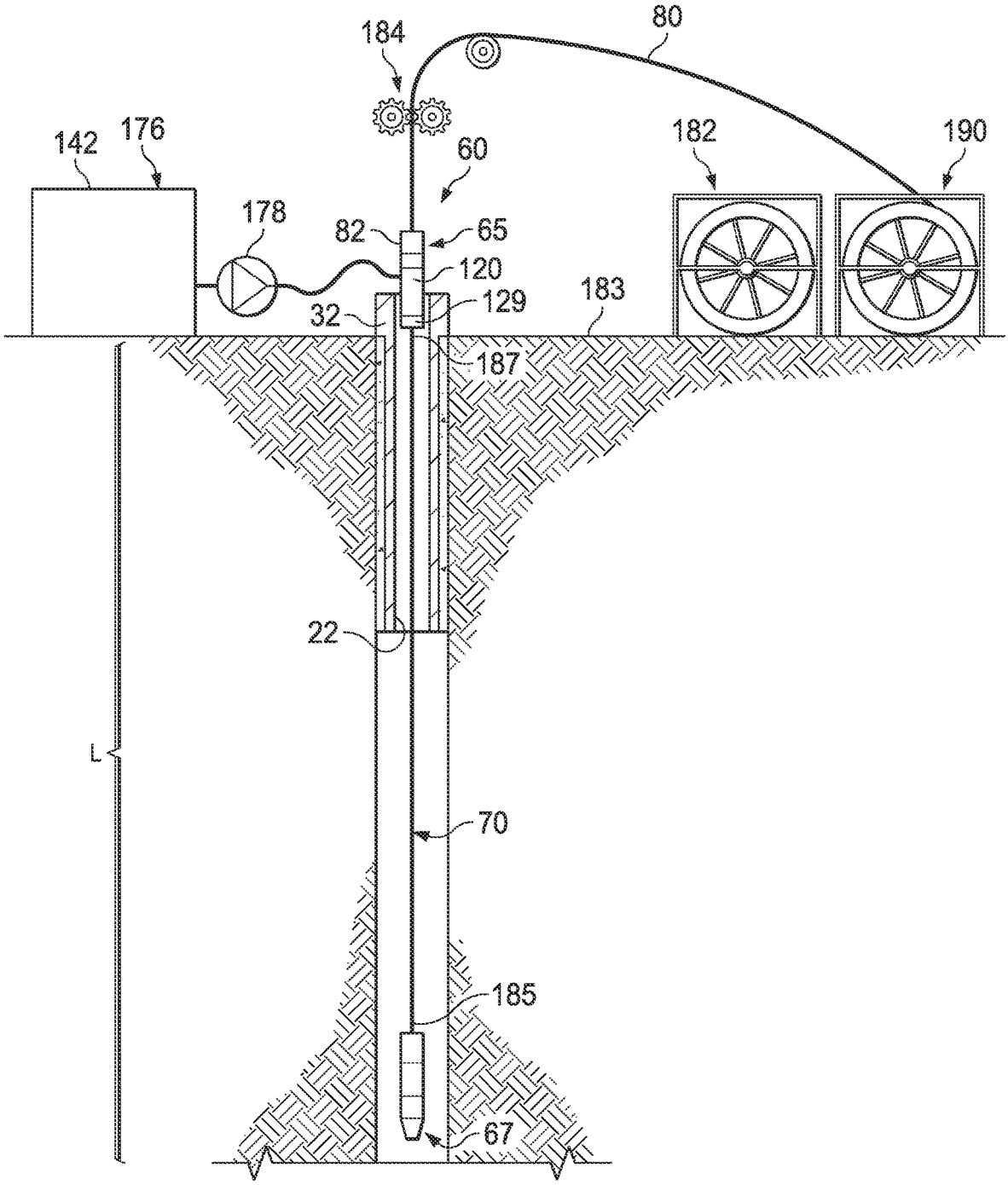

In FIG. 7B, elongated, bendable or semi-rigid bailer receptacle 70 is shown having been paid out to a length L that corresponds with the desired amount of bailer content 142 to be released into wellbore 22. In this operation, the weight of the injection assembly 67 assists in pulling bailer receptacle 70 into wellbore 22. Specifically, the volume of bailer content 142 to be released into wellbore 22 is determined and the length L of elongated bailer receptacle 70 sufficient for the volume of cavity 72 (see FIG. 3) to correspond to the needed volume of bailer content 142 is selected and paid out into wellbore 22. Thus, in the illustrated embodiment, a length L of bailer receptacle 70 is paid out into wellbore 22 with injection assembly 67 attached to the downhole end 185 of bailer receptacle 70. Once the needed length L of bailer receptacle 70 is paid out into wellbore 22, then the elongated, bendable or semi-rigid bailer receptacle 70 may be cut from bailer receptacle reel 182, exposing an uphole or second free end 187 of bailer receptacle 70. Thereafter a connector 129 may be installed to the second free end 187. The head assembly 65 may then be attached to this uphole free end 187 of bailer receptacle 70 utilizing attachment mechanism 129. In the illustrated embodiment, the head assembly 65 is secured, such as through the use of a dog collar engaging gripping area 131 (see FIG. 3), adjacent the wellhead 32 to permit attachment to bailer receptacle 70 and to permit bailer content 142 to be charged into bailer receptacle 70 via head assembly 65. Similarly, head assembly 65 may be attached to conveyance mechanism 80 via conveyance adapter 82 forming part of head assembly 65.

In other embodiments, rather than paying out bailer receptacle 70 from a bailer receptacle reel 182, bailer receptacle may be stored in the form of pre-made lengths that are made up via connections while being run to the desired length L, much in the same way that lengths of fire hoses may be join together to form a long length of fire hose. These pre-made lengths may be flat rolled or folded and stored for transport and handling. They may be picked up with crane a or the derrick (not shown), made up as would lengths of rigid pipe, and lowered into the well in sections.

With reference back to FIG. 3 and ongoing reference to FIG. 7B, as described above, in one or more embodiments, head assembly 65 may include a tubular portion 120 having an internal bore 69 in which is carried a first piston assembly 84*a* spaced apart from a second piston assembly 84*b* to define a fill chamber 122 of an initial volume within the tubular portion 120 between the two piston assemblies 84*a*, 84*b*. To the extent bailer receptacle 70 is a hose as described above in FIG. 7B, the uphole end 187 of the hose may be secured to head assembly 65, and specifically, tubular portion 120, utilizing attachment mechanism 129. In some embodiments, attachment mechanism 129 is a collar that clasps hose uphole end 187 to the second end 128 of tubular portion 120.

In other embodiments, a length L of flexible bailer receptacle 70 may be cut at the surface exposing both free ends 185, 187, and the injection assembly 67 and head assembly 65 may be attached to their respective free ends 185, 187 prior to lowering injection assembly 67 into wellbore 22.

In any event, bailer content 142 may be charged into tubular portion 120 though fill port 123. In the illustrated embodiment, a bailer content source 176 is shown at the surface 183 of wellbore 22. Utilizing a pump 178, bailer content 142 is pumped from source 176 into bailer receptacle 70 via tubular portion 120. It will be appreciated that as bailer content 142 is charged into tubular portion 120, second piston assembly 84*b* will begin to move towards second end 66 of tool body 62 (see FIG. 3) such that fill chamber 122 expands. This process may continue until bailer receptacle 70 extending into wellbore 22 is substantially full, at which point, filling can be discontinued and fill port 123 may be closed. It will be appreciated that when flexible bailer receptacle 70 is filled, the bailer content 142 ads rigidity to flexible bailer receptacle 70 and weight to the overall dump bailer assembly 60. Thereafter, dump bailer assembly 60 may be lowered into wellbore 22 utilizing conveyance mechanism 80 paid out from a cable reel 190. Upon retrieval, the injection assembly 67 and head assembly 65 may be detached from bailer receptacle 70, the bailer receptacle hose may be discarded, and a new length L of hose for use as the bailer receptacle 70 may be unwound from bailer receptacle reel 182. The bendable, foldable nature of the flexible hose makes it readily discardable following use. Alternatively, the bailer receptacle 70 may be flushed for re-use.

In one or more embodiments, wireline, slickline or other cable 80 may be utilized to lower a fully assembled dump bailer assembly 60 into wellbore 22 as described above. In such case, a cable reel 190 may also be positioned at the surface 183 of wellbore 22, as shown.

In other embodiments, dump bailer assembly 60 may be lowered on coiled tubing into wellbore 22. In such embodiments, it will be appreciated that in such embodiments, fluid to drive one or both piston assemblies 84 may be pumped from the surface instead of an integrated pump as described.

One benefit of embodiments of the foregoing dump bailer assembly is that there is no limitation on the bailer receptacle length, particularly where an integral pump is utilized. Thus, the volume of the bailer content is not limited as it would be in prior art dump bailer assemblies. Moreover, the foregoing dump bailer assembly while still having the advantage of a long, high capacity bailer is that it is quick to run and quick to fill as compared to prior art dump bailers assembled of pipe lengths. An additional benefit of the foregoing dump bailer assembly is that for smaller diameter wellbores, the diameter of the bailer receptacle can be reduced without sacrificing a loss of volume since the length of the bailer receptacle can be increased to compensate for a smaller diameter, all of which is made possible by the presence of the integrated pump.

As stated above, the bailer content need not be limited to cement slurry, but can be any fluid for release into the wellbore.

Thus, various embodiments of a dump bailer system for releasing fluids into a wellbore have been described. A dump bailer system may generally include a tool body having a first end, a second end and an exterior; an elongated bailer receptacle, carried by the tool body and having a cavity formed within the receptacle, the cavity having a first end and a second end; a piston slidably disposable within the cavity and movable between the first end and the second end of the cavity; and a pump carried by the tool body and in fluid communication with the first end of the cavity. In other embodiments, a dump bailer system may generally include a tool body having a first end, a second end and an exterior; an elongated bailer receptacle, carried by the tool body and having a cavity formed within the receptacle; the cavity having a first end and a second end; and a piston assembly slidably movable between the first end and the second end of the cavity; wherein the piston assembly comprises a first piston having a first side and a second side and an exterior surface, with a piston fluid passage extending between the first and second sides; and a rupture disk disposed along the fluid passage. In other embodiments, a dump bailer system may generally include a tool body having a first end, a second end and an exterior; an elongated bailer receptacle, carried by the tool body and having a cavity formed within the receptacle, the cavity having a first end and a second end; and a piston slidably disposable within the cavity and movable between the first end and the second end of the cavity; and a vibrator carried by the tool body. In yet other embodiments, a dump bailer system may generally include a head assembly having a flow passage therethrough; an injection assembly having a flow passage therethrough; a jointless, bendable elongated bailer receptacle having a cavity formed within the receptacle, the cavity having a first end in fluid communication with the flow passage of the head assembly and a second end in fluid communication with the flow passage of the injection assembly; and a piston slidably disposable within the cavity and movable between the first end and the second end of the cavity. In yet other embodiments, a dump bailer system may generally include a rigid head assembly having a flow passage therethrough; a rigid injection assembly having a flow passage therethrough; and a flexible bailer receptacle having an elongated cavity formed therein and in fluid communication with the flow passage of the rigid head assembly and the flow passage of the rigid injection assembly. In other embodiments, a dump bailer system may generally include a head assembly having a head assembly flow passage therethrough; an injection assembly having a first end and a second end, an exterior, a main flow bore extending from the first end of the injection assembly, and a first injection flow passage extending from the second end of the injection assembly and in fluid communication with the main flow bore; an elongated bailer receptacle having a first end and a second end with a cavity formed within the receptacle and extending between the first end and the second end of the receptacle, wherein the head assembly is attached to the first end of the elongated bailer receptacle with the head assembly flow passage in fluid communication with the cavity, wherein the injection assembly is attached to the second end of the elongated bailer receptacle with the main flow bore in fluid communication with the cavity; a piston slidably disposable within the cavity and movable between the first end and the second end of the cavity; and an engagement mechanism adjacent the second end of the injection assembly. In yet other embodiments, a dump bailer system may generally include a head assembly having a flow passage therethrough; an injection assembly having a flow passage therethrough; a jointless, bendable elongated bailer receptacle having a cavity formed within the receptacle, the cavity having a first end in fluid communication with the flow passage of the head assembly and a second end in fluid communication with the flow passage of the injection assembly, wherein the jointless, bendable elongated bailer receptacle is a hose; a piston slidably disposable within the cavity and movable between the first end and the second end of the cavity; a hose reel on which the hose is spooled; and a hose feeder. In yet other embodiments, a dump bailer system may generally include an elongated dump bailer body having a head assembly and an injection assembly; a rigid conveyance mechanism attached to the head assembly; and a plurality of centralizers disposed along at least a portion of the length of elongated body, wherein the centralizers are rollers.

For any of the foregoing embodiments, the dump bailer system may include any one of the following elements, alone or in combination with each other:

A pump carried by the tool body and in fluid communication with the first end of the cavity.

The pump is a positive displacement pump.

The pump is an electric pump.

The pump is in fluid communication with the exterior of the tool body.

The rigid conveyance mechanism is coiled tubing.

The head assembly comprises a wellbore sealing assembly.

The wellbore sealing assembly is an inflatable packer disposed about an exterior surface of the head assembly.

A fluid passage formed within the tool body and extending from the exterior of the tool body to the first end of the cavity, wherein the positive displacement pump is disposed along the fluid passage.

A fluid filter disposed along the fluid passage between the exterior of the tool body and the first end of the cavity.

A wireline adapter unit adjacent the first end of the tool body.

The dump bailer system further comprises an integral vibrator.

The dump bailer system further comprises an integral pump.

The positive displacement pump is positioned adjacent the first end of the tool body and a check valve positioned adjacent the second end of the tool body, the check valve being in fluid communication with the second end of the cavity.

The cavity is a bore.

The cavity is an elongated, axially extending cavity.

The receptacle is a tube.

The receptacle is a flexible hose.

The receptacle is a semi-rigid.

The receptacle is bendable.

The receptacle is coiled tubing.

The receptacle is a rigid cylindrical pipe.

The elongated bailer receptacle is jointless.

The elongated bailer receptacle is non-metal.

The elongated bailer receptacle comprises a plurality of interconnected pipe sections.

The receptacle comprises a single, continuous flexible joint.

A seal disposed about the exterior surface of the piston and sealingly engaging the receptacle.

The piston assembly comprises a first piston having a first side and a second side and an exterior surface, with a piston fluid passage extending between the first and second sides; and a rupture disk disposed along the fluid passage.

The piston is a wiper plug.

The piston assembly further comprises a second piston having a first side and a second side and an exterior surface, with a piston fluid passage extending between the first and second sides of the second piston; and a rupture disk disposed along the fluid passage of the second piston.

The tool body comprises a tubular filling chamber extending from a first end to a second end of the tubular filling chamber, with the second end of the of the tubular filling chamber attached to the elongated bailer receptacle adjacent the first end of the cavity, the tubular filling chamber having a first piston receiving zone defined adjacent the first end of the filling chamber, a second piston receiving zone defined adjacent the second end of the filling chamber, and a fluid filling port disposed in the tubular filling chamber between the first and second piston receiving zones.

A tubular landing chamber having a first end and a second end with an inner bore extending between the first end and the second end and a piston landing shoulder defined along the inner bore.

The inner bore having a first diameter adjacent the first end of the landing chamber and sized to receive a piston and a second diameter adjacent the second end of the landing chamber and smaller than the first diameter, the shoulder formed along the inner bore where the bore diameter changes. A vibrator carried by the tool body.

The vibrator is electric.

The vibrator is positioned adjacent the second end of the cavity.

The vibrator is positioned adjacent the first end of the tool body.

A jointless, bendable elongated bailer receptacle having a cavity formed within the receptacle, the cavity having a first end in fluid communication with the flow passage of the head assembly and a second end in fluid communication with the flow passage of the injection assembly The head assembly comprises a rigid pipe.

The head assembly comprises an upper tool body.

The injection assembly comprises a lower tool body.

An upper end of the jointless, bendable elongated bailer receptacle is attached to the head assembly and a lower end of the jointless, bendable elongated bailer receptacle is attached to the injection assembly.

The head assembly is rigid.

The injection assembly is rigid.

The head assembly comprises a positive displacement pump carried by the head assembly.

The pump is in fluid communication with an exterior of the upper head assembly.

A fluid passage formed within the tool body and extending from the exterior of the tool body to the first end of the cavity, wherein the positive displacement pump is disposed along the fluid passage.

The injection assembly comprises a check valve positioned along the flow passage of the injection assembly.

The bendable elongated bailer receptacle is a hose.

The hose comprises one or more outer layers of woven fabric with an inner layer of rubber.

The hose comprises at least one flexible outer layer and an inner flexible layer.

The outer flexible layer is selected from a group consisting of woven material, woven fabric, reinforced material, rubber, cloth, metal mesh.

A hose reel on which the hose is spooled; and a hose feeder.

A bailer receptacle reel on which the bailer receptacle is spooled; and a bailer receptacle feeder.

A bailer receptacle guide adjacent the bailer receptacle feeder.

The bailer receptacle guide positioned above the bailer receptacle feeder.

A cable reel on which is mounted a cable.

The cable is wireline.

The cable is slickline.

The cable is a coiled hose.

A wellhead, wherein the hose feeder is positioned above the wellhead.

The engagement mechanism is a latch assembly.

The latch assembly is mechanically actuated latch.

The latch assembly is an electrically actuated latch.

The latch assembly comprises a latch housing

A first flow valve disposed along the first flow passage.

The first is a one-way flow valve to permit fluid flow through the first flow passage from the main flow bore to the second end of the injection assembly.

The first flow valve is a pressure activated flow valve.

The injection assembly further comprising a second flow passage extending from the second end of the injection assembly and in fluid communication with the main flow bore, the second flow passage spaced apart from the first flow passage; a first flow valve disposed along the first flow passage to permit fluid flow through the first flow passage from the main flow bore to the second end of the injection assembly; and a second flow valve disposed along the second flow passage to permit fluid flow from the second end of the injection assembly to the main flow bore.

The first and second flow valves are each one-way valves.

A centralizer carried on the exterior of the injection assembly.

The centralizer is adjacent the second end of the injection assembly.

The centralizer comprises one or more rollers.

A first centralizer adjacent the first end of the injection assembly and a second centralizer adjacent the second end of the injection assembly.

A plurality of centralizers spaced apart from one another on each of the head assembly and injection assembly.

A sealing assembly disposed within the wellbore, wherein the sealing assembly comprises a seal tube having a bore formed therein, and a sealing element disposed about the seal tube.

The sealing assembly is a packer.

The sealing assembly is a plug.

The sealing assembly is a component in the wellbore tubular.

The sealing element is elastomeric.

The seal tube is a smooth bore tube.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed:

1. A method for injecting bailer content into a wellbore, the method comprising:

determining a volume of bailer content to be injected in a wellbore;

selecting a length of flexible bailer receptacle that corresponds with the determined volume;

cutting a flexible bailer receptacle to at least the selected length so as to have first and second bailer receptacle free ends;

attaching an injection assembly to the second free end of the flexible bailer receptacle;

attaching a head assembly to the first free end of the flexible bailer receptacle; and lowering the injection assembly into the wellbore on the flexible bailer receptacle prior to attaching the head assembly to the flexible bailer receptacle.

2. The method of claim 1, wherein lowering comprises paying out the flexible bailer receptacle from a bailer receptacle reel to lower the injection assembly into the wellbore; once the bailer receptacle in the wellbore approximately corresponds to the selected length of flexible bailer receptacle, cutting the flexible bailer receptacle from the reel and attaching the head assembly to the flexible bailer receptacle; injecting bailer content into the head assembly to fill the flexible bailer receptacle; attaching a cable to the head assembly and lowering the flexible bailer receptacle into the wellbore.

3. The method of claim 2, further comprising operating a pump carried by the head assembly to utilize wellbore fluid to drive the bailer content out of the flexible bailer receptacle; and thereafter, recovering the flexible bailer receptacle from the wellbore, removing the flexible bailer receptacle from the head assembly and injection assembly; and discarding the removed flexible bailer receptacle.

4. The method of claim 1, wherein cutting a flexible bailer receptacle to the selected length comprises cutting a flexible hose into a plurality of pre-made, rolled lengths; unrolling the pre-made lengths and connecting the pre-made lengths to form a flexible bailer receptacle of at least length L.

5. A method for injecting bailer content into a wellbore, the method comprising:

determining a volume of bailer content to be injected in a wellbore;

selecting a length of flexible bailer receptacle that corresponds with the determined volume;

attaching an injection assembly to a downhole free end of the flexible bailer receptacle so as to partially assemble a dump bailer assembly;

lowering the partially assembled dump bailer assembly into the wellbore on the flexible bailer receptacle;

after lowering the partially assembled dump bailer assembly, cutting the flexible bailer receptacle to at least the selected length so that the flexible bailer receptacle has an uphole free end; and attaching a head assembly to the uphole free end of the flexible bailer receptacle so as to fully assemble the dump bailer assembly, and thereafter, lowering the fully assembled dump bailer assembly into the wellbore on a conveyance mechanism.

6. A method for injecting bailer content into a wellbore, the method comprising:

determining a volume of bailer content to be injected in a wellbore;

selecting a length of flexible bailer receptacle that corresponds with the determined volume;

attaching an injection assembly to a downhole free end of the flexible bailer receptacle;

lowering the injection assembly into the wellbore on the flexible bailer receptacle from a bailer receptacle reel;

cutting the flexible bailer receptacle to at least the selected length so that the flexible bailer receptacle has an uphole free end; and attaching a head assembly to the uphole free end of the flexible bailer receptacle and lowering the head assembly into the wellbore on a conveyance mechanism unspooled from a second reel, wherein lowering the injection assembly comprises unrolling the flexible bailer receptacle as the injection assembly is lowered into the wellbore.

7. The method of claim 6, wherein unrolling the flexible bailer receptacle comprises paying out the flexible bailer receptacle from the bailer receptacle reel.

8. The method of claim 6, wherein the conveyance mechanism is a wireline attached to the head assembly; the method further comprising filling the flexible bailer receptacle with bailer content; and deploying the filled, flexible bailer receptacle into the wellbore on the wireline by applying a head pressure to the injection assembly in order to urge the flexible bailer receptacle into the wellbore.

* * * * *